US011401125B2

(12) United States Patent
Frederick et al.

(10) Patent No.: US 11,401,125 B2
(45) Date of Patent: Aug. 2, 2022

(54) WRAPPING MATERIAL ROLL TENSIONER SYSTEM, METHOD OF MANUFACTURE AND USE

(71) Applicant: SOURCE UNLIMITED LLC, Lebanon, NJ (US)

(72) Inventors: Michael A. Frederick, Lebanon, NJ (US); John F. Abreu, Jackson, NJ (US)

(73) Assignee: SOURCE UNLIMITED LLC, Lebanon, NJ (US)

( * ) Notice: Subject to any disclaimer, the term of this patent is extended or adjusted under 35 U.S.C. 154(b) by 533 days.

(21) Appl. No.: 16/580,073

(22) Filed: Sep. 24, 2019

(65) Prior Publication Data

US 2020/0017327 A1 Jan. 16, 2020

Related U.S. Application Data

(63) Continuation-in-part of application No. 15/657,118, filed on Jul. 22, 2017, now Pat. No. 10,717,620.

(51) Int. Cl.
*B65H 23/08* (2006.01)
*B65H 16/00* (2006.01)
(Continued)

(52) U.S. Cl.
CPC ..... *B65H 23/085* (2013.01); *B65B 5/02* (2013.01); *B65B 5/04* (2013.01); *B65B 25/146* (2013.01); *B65H 16/005* (2013.01); *B65H 35/06* (2013.01)

(58) Field of Classification Search
CPC .... B65H 35/06; B65H 16/005; B65H 25/146; B65H 23/085; B65B 5/02
(Continued)

(56) References Cited

U.S. PATENT DOCUMENTS 1,807,274 A 5/1931 Beidler
1,885,996 A * 11/1932 Duffin ..... B65D 83/0841 225/53
(Continued)

FOREIGN PATENT DOCUMENTS

EP 0358477 A2 3/1990
GB WO2003099693 A1 12/2003

OTHER PUBLICATIONS

Internet Publication—Aluminum Foil Dispense—found at: https://www.organizeit.com/aluminumfoil-dispenser.asp.

*Primary Examiner* — Robert F Long
*Assistant Examiner* — Xavier A Madison
(74) *Attorney, Agent, or Firm* — Ernest D. Buff & Associates, LLC; Ernest D. Buff

(57) ABSTRACT

A dispensing box with a roll tensioner houses a material roll and maintains a material cutting edge in an upward position for easy grasping during use. The roll tensioner comprises distal and proximal end sections with opposing bottom tabs separated by a spring back reversion section. A roll tensioner slide assembly integrated in the front wall of the dispensing box has opposing parallel slits terminating at opposing parallel slots with parallel locking flaps. Opposing bottom tabs of a roll tensioner are inserted through the parallel slots, resting in a first position during non-use and adapted to be slid down into a second position in the parallel slits when later engaged for use to retain the material cut edge in the upward position for easy grasping. The locking flaps have break-away top and bottom walls abutting a bend wall and are in a stored position and later opened outward to a locking position during use to prevent movement of the roll tensioner.

23 Claims, 29 Drawing Sheets

(51) Int. Cl.

| | |
|---|---|
| ***B65H 35/06*** | (2006.01) |
| ***B65B 25/14*** | (2006.01) |
| ***B65B 5/04*** | (2006.01) |
| ***B65B 5/02*** | (2006.01) |

(58) Field of Classification Search
USPC ..... 493/52
See application file for complete search history.

(56) References Cited

U.S. PATENT DOCUMENTS

| | | | | |
|---|---|---|---|---|
| 2,115,867 | A * | 5/1938 | McConnell | B65D 83/0841 225/48 |
| 2,276,590 | A | 3/1942 | Petskeyes et al. | |
| 2,326,220 | A | 8/1943 | Henning et al. | |
| 2,752,106 | A | 6/1956 | Thompson | |
| 2,816,655 | A | 12/1957 | Crozier et al. | |
| 2,936,936 | A | 5/1960 | Sano | |
| 3,281,034 | A * | 10/1966 | Woodling | B65D 85/672 225/48 |
| 3,709,445 | A | 9/1973 | Adams | |
| 3,870,212 | A | 3/1975 | Polk | |
| 3,949,947 | A | 4/1976 | Youngquist | |
| 4,196,647 | A | 4/1980 | Fish | |
| 4,231,560 | A | 11/1980 | Stohlquist | |
| 4,285,474 | A | 8/1981 | Perez | |
| 4,787,543 | A | 11/1988 | Fabo | |
| 4,832,271 | A | 5/1989 | Geleziunas | |
| 4,840,299 | A * | 6/1989 | Burns | B65H 35/002 225/48 |
| 4,998,655 | A | 3/1991 | Huang | |
| 6,716,317 | B2 | 4/2004 | Gafner et al. | |
| 6,725,753 | B2 | 4/2004 | Bell | |
| 8,733,218 | B2 | 5/2014 | Hansen et al. | |
| 9,284,085 | B2 | 3/2016 | Pace | |
| 9,918,598 | B2 | 3/2018 | Osbone | |
| 10,202,255 | B2 | 2/2019 | Sabol | |
| 2008/0127791 | A1 | 6/2008 | Benedetti et al. | |
| 2011/0108599 | A1 | 5/2011 | Nottingham | |
| 2011/0147254 | A1 | 6/2011 | Pierron | |

* cited by examiner

[ PRIOR ART ]

[ SUBJECT ROLL TENSIONER ]

WRAPPING MATERIAL ROLL TENSIONER SYSTEM, METHOD OF MANUFACTURE AND USE

CROSS-REFERENCE TO RELATED APPLICATIONS

The present application is a continuation in part of U.S. patent application Ser. No. 15/657,118, filed Jul. 22, 2017, the disclosure of which is hereby incorporated in its entirety by reference thereto.

1. FIELD OF THE INVENTION

The present invention generally relates to material roll dispensing assemblies, methods of manufacturing same and methods of use; and more particularly to dispensing assemblies that position dispensing materials for easy grasping, including dispensing materials such as aluminum foil, wax paper, parchment paper, wrapping paper and the like that are rolled and/or spooled onto a tube or core.

2. DESCRIPTION OF THE PRIOR ART

Barrier wrappings, packaging wrap that is spooled onto a tube or core, typically composed of cardboard or other fiber materials, have a plethora of applications, including food coverings and other wrapping materials which cover, wrap, contain, store or preserve goods. These wrapping materials include, for non-limiting example, aluminum foil, wax paper, freezer paper, parchment paper, deli wrap, paperboard (cardboard) produced from chemical pulp produced in the Kraft process (Kraft paper), as well as other similar materials in both gauge and weight, which are spooled onto a tube or core in a similar manner. Such wrapping materials are arranged on the tube or core and as the user utilizes the wrapping material, the material is unrolled or unspooled and cut along a metal cutter strip. When the section is removed or cut from the wrapping material spool the remaining wrapping material edge drops down to the bottom of the box containing the wrapping material spool. As a result, the wrapping material becomes crinkled and disheveled, and the user must struggle to find and grab the material edge with his/her fingers. Often, the user's fingers or hands inadvertently contact the metal cutter strip, which causes scratching, abrasions and/or cuts on the fingers or hands. This problem is especially prevalent with aluminum foils and some papers where instances of both paper cuts to fingers, from the sharp edge of a foil or paper sheet as well as abrasions to the back of the hand from the metal cutter, frequently occur. Heretofore disclosed and/or utilized tensioner and/or barrier wrapper devices fail to provide a cost-effective solution to this everyday problem experienced by consumers.

Examples of various tensioner and/or barrier wrapper devices are set forth summarily below:

U.S. Pat. No. 2,276,590 to Petskeyes et al. discloses a paper holding and tensioning means generally constructed having a holding bail which cooperates with an article elevator to hold one end of a piece of wrapping paper while the elevator is reciprocated in wrapping operation. The holding means is arranged and constructed to release and reengage the wrapping paper at the completion of the reciprocation or elevating cycle of the elevator. Paper on an article is tensioned while being wrapped or substantially wrapped as a result of the reciprocating movement of the elevator.

U.S. Pat. No. 2,326,220 to Henning et al. discloses a tensioning apparatus for maintaining the desired tension in an element being applied to a second element. In accordance with one embodiment of the invention, an apparatus is provided for maintaining constant tension in a web being wound from a pad or roll mounted concentrically of a constantly advancing cable onto said cable. The constant tension is effected by utilizing the speed-torque characteristic of an induction type torque motor to apply, through a planetary differential mechanism, a torque tending to rotate a spider on which the feed pad or roll is mounted in a direction opposite to the direction in which the motor which supplies power to advance the cable also tends to drive the pad through the differential mechanism.

U.S. Pat. No. 4,231,560 to Stohlquist discloses a tension controlled apparatus for feeding web material from a supply source to processing equipment of the type that exerts a pulling force on the web. The apparatus includes a drive wheel and a driven wheel mounted for rotation about an axis parallel to the drive wheel and for shifting movement toward and away from the drive wheel. A web feed roller is connected coaxially to the driven wheel for rotation thereby. Means are provided for guiding the web material to cause it to wrap partway around the web feed roller as it passes from the supply source to the processing equipment. The web material exits from the web feed roller in an exiting direction having a substantial component in a direction to shift the driven wheel into driving engagement with the drive wheel in response to tension applied by the processing machine on the web of material exiting from the feed roller.

U.S. Pat. No. 3,870,212 to Polk discloses a dispenser-holder of simple construction for foils which come packaged in a box of substantially square cross-section. The dispenser-holder is adapted to receive and hold the box. The holder has a rigid ledge with a cutting edge so that the foil may be unrolled from the box and cut to the desired size with one hand. After cutting, a protruding edge of the foil remains on the roll, and extends over the rigid ledge so that the next sheet is readily obtained therefrom.

U.S. Pat. No. 6,716,317 to Gafner et al. discloses a tension decurler for web material. The material is decurled by controlling web tension as well as the angle of wrap on a decurler roll and a cooperating pivot roll, all without affecting web tension in the downstream web converting process. An upstream brake roll and a downstream pull roll control web tension within the decurler apparatus and independent decurler rolls are provided for removing up-curl and down-curl.

U.S. Pat. No. 8,733,218 to Hansen et al. discloses an apparatus for dispensing sheet material from a sheet material dispenser. Dispenser embodiments include drive and tension rollers supported within a housing forming a nip therebetween. Pulling of sheet material through the nip and against the drive roller rotates the drive roller. Dispenser embodiments may include a cutting mechanism powered by drive roller rotation with an improved carrier-supported blade permitting highly-efficient dispenser operation. Dispenser embodiments may include a sheet material tail length adjuster which permits the attendant to shorten or lengthen the tail length extending away from the dispenser. Dispenser embodiments may further include a sheet material conservation feature which imposes a delay between dispense cycles, encouraging use of a single sheet of material and discouraging sheet material waste.

U.S. Pat. No. 9,284,085 to Pace discloses a device for holding and handling a roll of wrapping material. The device has a tube handle, a tube extension adjustably connected to the tube handle, a top-end cap on the tube handle, a bottom end cap on the tube extension, and a tensioning means, wherein the bottom end cap releasably holds the roll of wrapping material on the tube extension against the tensioning means. The tensioning means is adjustable while the device is in use, applying wrapping material to an item to be wrapped.

U.S. Patent Application No. 2008/0127791 to Benedetti et al. discloses a film dispenser comprising a housing adapted to receive and hold a roll of film. The dispenser has a dispensing opening through which a layer of the film may pass. In addition, the dispenser is provided with a movable cutting unit having a blade mounted therein. The dispenser further comprises a cutting channel-shaped and positioned to receive the blade. It is preferred that the dispenser has means to maintain tension in the film as it is cut.

U.S. Patent Application No. 2011/0147254 to Pierron discloses a foil packaging for soft food masses. A container film shape is formed into the shape of an open container and a lidding film is sealed onto the container film closing the container with a lid. The container film and lidding film are multi-layered. One of the layers is an aluminum foil, which is optionally pre-lacquered and if desired printed on and lacquer-coated on one side. The aluminum foil of the container film and the lidding film is coated with a polymer, and a hot-sealing lacquer is provided on the polymer layer of the container film. The polymer, optionally coated with hot-sealing lacquer, may be situated on the sealing side of the aluminum foil of the lidding film, and a corrosion protection layer, if desired in the form of a polymer, is provided on the other side of the aluminum foil. Alternatively, the aluminum foil of the lidding film may be coated on the sealing side with hot-sealing lacquer and the polymer layer, optionally coated with hot-sealing lacquer, is situated on the other side of the aluminum foil.

Foreign Patent Application No. WO/2003/099693 to Benedetti et al. discloses a film dispenser (10) comprising a housing (12) adapted to receive and hold a roll of film (14) and having a dispensing opening (50) through which a layer of the film may pass. The dispenser is provided with a movable cutting unit having a blade (30) mounted therein. The dispenser (10) further comprises a cutting channel (26) shaped and positioned to receive said blade (30). It is preferred that the dispenser (10) have means to maintain tension in the film as it is cut.

Foreign Patent Application No. EP0358477 to Asbury et al. discloses a tape dispenser including an automatic tension control mechanism and provision for auto-splicing the tail portion of one tape to the leading portion of another. The tensioning mechanism includes a brake band that extends at least partially about a tape spindle and is tensioned in response to the position of a spring-biased tensioning roller over which the tape is routed.

Internet Publication "Aluminum Foil Dispenser" found at http://www.organizeit.com/aluminum-foil-dispenser.asp discloses an aluminum foil dispenser having a magnetic lid and slide cutter that allows the user to cut a desired portion of aluminum foil. The dispenser can be refilled with store-bought rolls of aluminum foil or wax paper for reuse. Perforated end tabs or end locks located on end walls of dispenser boxes have been provided in the art to hold rolls within the box, such as those sold by Reynolds wrap. These end locks provide perforated tabs that are generally pressed from the exterior of the box, and face within the interior to hold a dispenser roll in place so that it does not pull out from the box during use. Various end locks and improvements thereon have been provided. For example: U.S. Pat. No. 10,202,255 to Sabol discloses a dispensing roll lock device having at least one rod and end caps designed to attach to ends of the rods, wherein the rod is sized to be inserted through end locks of the sides of the dispensing box and through the roll in the box to secure the rod in the box. Other dispenser adapters have been provided in the art to address securement of the roll in the dispenser, as well as increase dispensing capability. For example: U.S. Pat. No. 4,840,299 to Burns discloses a dispenser adapter to improve the dispensing of thin webs from rolls of material contained in conventional dispensing boxes is specially configured to provide its benefits of anti-recoil and risk free tearing to a wide range of dispensing boxes via an adapter particularly suited to being retrofitted to commercially available dispensing boxes, including a pressure plate, loaded by one or more metal springs. U.S. Pat. No. 6,725,753 to Bell discloses a dispenser for holding and dispensing rolls of flexible material including mounts for holding one or more rolls of flexible material, with the front wall of the box having a blade fixedly mounted thereto and is recessed within a pressure plate contactable against a portion of the sheet to be removed and held on an anvil stop surface formed by roughed edges. US Patent App. Pub. No. 20110108599 to Nottingham discloses a dispenser that includes a housing configured to receive and hold a roll of film. The housing has a dispensing opening through which a section of film can pass.

Despite the aforementioned tensioner and/or barrier wrapper devices, problems in barrier wrapper roll edge tension and deformation still exist. For example, current tensioner and/or barrier wrapper devices do not provide a mechanical device that provides a cost-effective way to prevent the roll edge of a barrier wrapper roll, such as aluminum foil, wax paper, parchment paper, etc., from falling below the roll, thereby causing it to deform and become difficult to grasp when used.

Accordingly, there exists a need in the art for a material roll dispenser systems and assemblies that include a device that maintains the position of the material edge at or near the top of the box side wall so that an end user can readily grab the material end without having to reach within the box and risk disheveling the wrapping material and/or injuring his/her fingers or hands.

SUMMARY OF THE INVENTION

The present invention provides methods and systems of manufacture of a dispensing box with a roll tensioner for housing a material roll and maintaining a material cutting edge during use, method of use, and dispensing box with roll tensioner system. The methods and systems provide a wrapping material roll tensioner for barrier wrappings or packaging wrap that is spooled onto a tube or core, typically composed of cardboard, a fibrous material, and/or a polymeric material. The subject roll tensioner provides an economical, novel approach that addresses problems in the art associated with slippage and maintenance of the cut edge of a wrapping material roll. Providing an improvement in the packaging wrap art, the roll tensioner is directed to a device that maintains the cut area of the wrapping upward and away from the front wall of the box, thereby creating a gap between the front wall of the box and the roll of wrapping material, or in some instances, above the metal cutter strip, thereby preventing the remaining wrapping end from dropping down to the bottom of the box after each use of the wrapping material. Prevention of the wrapping material edge from dropping down to the bottom of the box results in an easily accessible edge for the user to grab without needing to search around the bottom of the box, struggling with wrapping material. Wrapping material is readily accessed and advanced, and cuts and scrapes to the hand and fingers are mitigated.

The term wrapping material as used herein refers generally, but non-limiting to wrapping paper, aluminum foil, wax paper, freezer paper, parchment paper, deli wrap, paperboard (cardboard) produced from chemical pulp produced in process such as the Kraft process (for example sold under the trade name Kraft paper), butcher paper, non-stick coated materials, as well as other similar materials in both gauge and weight.

The term "slit" as used herein generally refers to a long, narrow cut or opening, line or incision. A slit can also refer to a "kiss cut", "cut-score", "slit-score", "score" or a combination thereof.

The term "slot" as used herein generally refers to a narrow passage, opening or gap.

The terms "kiss cut", "cut-score", "slit-score" or "score" as used herein generally refers to a partial depth cut that contains a connection along a slit or cut/incision preventing the separation of a slit or incision until a force is applied. A kiss cut, cut score or slit score does not generally penetrate through the material being cut, but allows for breakaway.

The terms "connection points" or "nicks" as used herein generally refers to a link or links designed to bind or bridge one die cut part or side to an adjoining part or side that assist in holding the kiss cut/cut/slit/incision together as needed depending on slit length, resulting in a small uncut connection between the cut material (e.g. in this case a cardboard box).

The terms "hinge", "fold", "fold line", "bend elbow", "fold point", "crease" or "elbow" refer generally to a hinge or fold point where two sections bend at an angle, engaging in relation to one another, such as a 90 degree bend, for non-limiting example.

In a first embodiment, there is provided a method of manufacture of a dispensing box with a roll tensioner for housing a material roll and maintaining a material cutting edge during use, the dispensing box comprising a front wall with a top edge having a cutter strip and a bottom edge abutting a bottom wall, back wall, top wall with closure flap and end walls adapted to form an interior for housing the material roll. In Step 1, a tensioner slide assembly is formed, integrated in the front wall of the dispensing box which is in a flat configuration. The tensioner slide assembly comprises (i) two opposing parallel slits extending on the front wall of the dispensing box, (ii) two opposing parallel slots adjoining the slits extending through the front wall of the dispensing box, the parallel slots sharing a primary assembly side wall with the parallel slits; and (iii) two opposing parallel locking flaps integrated with the parallel slots sharing a secondary assembly wall side with the parallel slots. The locking flaps have flap top and flap bottom walls that are adapted to break-away terminating at a fold line, the locking flaps being in a stored position prior to use and adapted to open to a locking position. The flap top and flap bottom walls break-away when force is applied, and the locking flaps are then appointed to be bent outward along the fold line when the dispensing box is configured for use by an end-user. Preferably the parallel slits include slits with nicks/kiss cuts/kiss cuts that break-away to open the slit when the parallel slits are ready for the roll tensioner to move therein to its second position for use. Additionally, preferably, the locking flap's top and bottom walls are slits with nicks/kiss cuts/kiss cuts that break-away when the locking flaps are pushed outward, separating to break-away from the inside of the front wall and pressed outward to bend at the bend wall at the bend, crease, fold to facilitate bend without tearing. In Step 2, preferably the cutter strip is affixed to the top edge of the front wall of the dispensing box. Next, in Step 3, a roll tensioner is inserted into the parallel slits. This is preferably done using a mandrel and saddle assembly as described hereinafter. The roll tensioner comprises distal and proximal end sections separated by a spring back/reversion section, the proximal end section having opposing bottom tabs and a center bottom tab. The distal end is adapted to extend downward via the spring back/reversion section when a force is applied. Opposing bottom tabs of the roll tensioner are inserted through the parallel slots of the tension slide assembly. The roll tensioner is adapted to rest in this position, referred to as a "first position", during non-use and is appointed to be slid down the parallel slots into the parallel slits, referred to as a "second position", when later engaged for use. In Step 4, the dispensing box is folded at bend or fold lines between the front wall and the bottom wall and the back wall and the top wall with closure flap. Pressure is applied to the closure flap and adhering the closure flap to the front wall by way of glue spots applied below the cutter strip. It is noted that glue spots may be applied prior to the cutter strip on the front wall. The glue spots are adapted to adhere the closure flap to the front wall. In Step 5, the material roll is inserted into the interior of the dispensing box. The roll tensioner rests in the interior of the dispensing box proximal to the top edge of the front wall in the parallel slots with its distal end curving over the material roll laying proximal to the interior of the top wall of the dispensing box. Next, at Step 6, the end walls of the dispensing box are closed and the dispensing box readied for shipment. The roll tensioner is adapted to rest in the first position until the roll tensioner is engaged to move into the second position during use. When in the second position the roll tensioner's distal end section is adapted to rest against the wrapping material proximal to the wrapping material cut edge to retain the wrapping material cut edge in an upward, substantially parallel position to the interior front wall of the wrapping material box for easy grasping of the wrapping material cut edge. It is noted that these steps are presented in a preferred order, but the order may be re-arranged to suit manufacturing systems and methods without departing from the scope of the invention.

In another aspect of the invention, there is provided a method of manufacture of a dispensing box with a roll tensioner for housing a material roll and maintaining a material cutting edge during use, the dispensing box comprising a front wall with a top edge having a cutter strip and a bottom edge abutting a bottom wall, back wall, top wall with closure flap and end walls adapted to form an interior for housing the material roll. The method comprising the step of forming a tensioner slide assembly integrated in the front wall of the dispensing box, the tensioner slide assembly comprising: (i) two opposing parallel slits extending on the front wall of the dispensing box; (ii) two opposing parallel slots adjoining the slits extending through the front wall of the dispensing box, the parallel slots sharing a primary assembly side wall with the parallel slits; (iii) two opposing parallel locking flaps integrated with the parallel slots sharing a secondary assembly wall side with the parallel slots, the locking flaps having flap top and flap bottom walls that are adapted to break-away terminating at a fold line, the locking flaps being in a stored position prior to use and adapted to open to a locking position when the flap top and flap bottom walls break-away upon application of force, bending the locking flaps outward along the fold line when the dispensing box is configured for use by an end-user. Next, the method includes the step of inserting a roll tensioner into the parallel slits, the roll tensioner comprising distal and proximal end sections separated by a spring back/reversion section, the proximal end section having opposing bottom tabs and a center bottom tab and the distal end being adapted to extend downward via the spring back/reversion section when a force is applied. The opposing bottom tabs of the roll tensioner are inserted through the parallel slots, wherein the roll tensioner is adapted to rest in the first position during non-use and to be slid down the parallel slots into the parallel slits into the second position when later engaged for use. The roll tensioner is adapted to rest in the first position until the roll tensioner is engaged to move into the second position during use, when in the second position the roll tensioner's distal end section is adapted to rest against the wrapping material proximal to the wrapping material cut edge to retain the wrapping material cut edge in an upward, substantially parallel position to the interior front wall of the wrapping material box for easy grasping of the wrapping material cut edge.

Another aspect of the invention provides a dispensing box with a roll tensioner system for housing a material roll and maintaining a material cutting edge during use, the dispensing box comprising a front wall with a top edge having a cutter strip and a bottom edge abutting a bottom wall, back wall, top wall with closure flap and end walls adapted to form an interior for housing the material roll, comprising a tensioner slide assembly adapted to receive the roll tensioner. The tensioner slide assembly is integrated in the front wall of the dispensing box in a flat configuration. The tensioner slide assembly is constructed having two opposing parallel slits located on the front wall of the dispensing box. The tensioner slide assembly includes two opposing parallel slots adjoining the slits extending through the front wall of the dispensing box, the parallel slots sharing a primary assembly side wall with the parallel slits. Two opposing parallel locking flaps are integrated with the parallel slots sharing a secondary assembly wall side with the parallel slots. The locking flaps have flap top and flap bottom walls that are adapted to break-away terminating at a fold line. The locking flaps being in a stored position prior to use and adapted to open to a locking position when the flap top and flap bottom walls break-away upon application of force, bending the locking flaps outward along the fold line when the dispensing box is configured for use by an end-user.

In another aspect of the invention there is provided a method of using a dispensing box with a roll tensioner system for housing a material roll and maintaining a material cutting edge during use, the dispensing box comprising a front wall with a top edge having a cutter strip and a bottom edge abutting a bottom wall, back wall, top wall with closure flap and end walls adapted to form an interior for housing the material roll. The method comprises the steps of: (a) opening a dispensing box to expose the material roll and the roll tensioner, the roll tensioner comprising distal and proximal end sections separated by a spring back/reversion section, the proximal end section having opposing bottom tabs and a center bottom tab and the distal end being adapted to extend downward via the spring back/reversion section when a force is applied; (b) preparing the roll tensioner for use by sliding the roll tensioner resting in a first position in a tensioner slide assembly to a second position, the tensioner slide assembly integrated in the front wall of the dispensing box, comprising: (i) two opposing parallel slits extending on the front wall of the dispensing box; (ii) two opposing parallel slots adjoining the slits extending through the front wall of the dispensing box, the parallel slots sharing a primary assembly side wall with the parallel slits; (iii) two opposing parallel locking flaps integrated with the parallel slots sharing a secondary assembly wall side with the parallel slots, the locking flaps having flap top and flap bottom walls that are adapted to break-away terminating at a fold line, the locking flaps being in a stored position prior to use and adapted to open to a locking position when the flap top and flap bottom walls break-away upon application of force, bending the locking flaps outward along the fold line when the dispensing box is configured for use by an end-user; (c) breaking away or separating the parallel slits and sliding the roll tensioner from the first position downward from the parallel slot to the second position in the parallel slits so that the opposing bottom tabs of the roll tensioner abuts a bottom end point of the parallel slits; and (d) activating the locking flaps by opening the locking flaps by breaking away the flap top and flap bottom walls bending at the bend wall to the locking position. Whereby the roll tensioner is adapted to rest in the first position until the roll tensioner is engaged to move into the second position during use, when in the second position the roll tensioner's distal end section is adapted to rest against the wrapping material proximal to the wrapping material cut edge to retain the wrapping material cut edge in an upward, substantially parallel position to an interior front wall of the wrapping material box for easy grasping of the wrapping material cutting edge.

BRIEF DESCRIPTION OF THE DRAWINGS

The invention will be more fully understood and further advantages will become apparent when reference is had to the following detailed description of the preferred embodiments of the invention and the accompanying drawings, in which.

DETAILED DESCRIPTION OF THE DISCLOSURE

Figure 1:
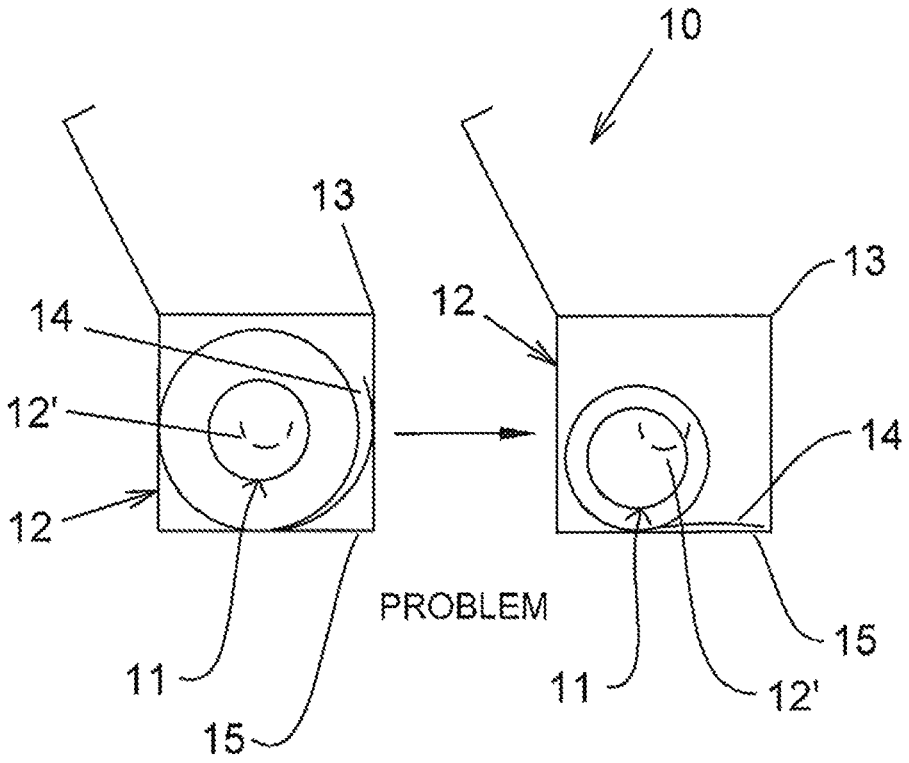
FIG. 1 illustrates a side plan view depicting the problem in the prior art which the subject roll tensioner solves.

The best mode for carrying out the present disclosure is presented in terms of the embodiments herein. The embodiments described herein comprise detail used for illustrative purposes and are subject to many variations. It is understood that various omissions and substitutions of equivalents are contemplated, as circumstances may suggest or render expedient, but are intended to cover the application or implementation without departing from the spirit or scope of the present disclosure. Further, it is to be understood that the phraseology and terminology employed herein are for the purpose of the description and should not be regarded as limiting. The headings utilized within the description are for convenience only and have no legal or limiting effect.

The subject invention provides a roll tensioner device that maintains the cut area of the wrapping parallel with, or in some instances, above the metal cutter strip. The subject roll tensioner prevents the remaining wrapping end from dropping down to the bottom of the box after each use of the wrapping material. By preventing the wrapping material edge from dropping down to the bottom of the box, the user no longer needs to search around the bottom of the box struggling to grab the edge of the wrapping. Cuts, scrapes and abrasions to the hand and fingers are thereby prevented, and the integrity of the wrapping material is maintained. While preventing injury to the hand/fingers and maintaining the integrity of the wrapping material, the subject roll tensioner does not interfere or obstruct a normal customer use in any way. The roll tensioner is appointed to be installed to the inside/center front wall of the box in an inconspicuous position. This allows the end-user to effortlessly grip onto the wrapping, regardless of left or right-handed use. A space is created between the wrapping material and the metal cutter that allows the user to hold onto the wrapping and pull out the desired length. Once the desired length is removed, the wrapping can be cut in the usual way, and the wrapping edge will stay held up near the cutter and ready for the next use.

Packaging of the roll tensioners may be accomplished by randomly placing loose parts into a cardboard box for bulk shipments. Parts may be easily removed from the box as needed using this method. Alternately, the roll tensioners, while still attached to the main carrier, may be spooled onto a core (into a roll shape) for automated or semi-automated dispensing. Either way, boxes may be shrink-wrapped, placed on a standard pallet and bulk shipped to the intended destination via standard shipping methods.

The roll tensioner can be installed in at least two different ways, depending on the desired distribution method. Automated manufacturing methods can vary; however, a first option entails installing the part mechanically, from a spool, or individual stacked parts loaded in a hopper or magazine type dispenser, into a guided mandrel or similar device, in an automated way, at the time of wrapping material manufacture. Installation should occur prior to placing the wrapping roll into the packaging box. This will allow automation which is critical to any fast-pace modern manufacturing line. The roll tensioner can be attached to the inside of the box (first having the backer removed from the adhesive tape already on the part); the roll tensioner is mechanically bent over as the wrapping roll is placed into the box, setting the tensioner into the correct position. The box would then be closed and sealed as in a conventional manner. No changes would be required to current shipping procedures. The second method, applicable when wrapping material is sold at retail or directly to an end-user, provides for the end-user to open the box and remove the wrapping roll. Alternatively, instead of removing the wrapping/material roll, the front wall of the box may be bent out via center front to make room to install on inside front wall. The box front wall will naturally "give" providing the needed space. The end-user then peels off the adhesive backer from the roll tensioner with his/her fingers and places the adhesive (sticky side) portion of the tensioner firmly against the inside, front and center of the box. At this point, the top of the tensioner protrudes up beyond the top inside edge of the box (above the metal cutter strip). Taking the wrapping roll in hand, the end-user pushes the wrapping roll against the tensioner as he/she places the roll into the box making sure the roll tensioner gently bends over into an upside-down "u" shape (see FIGS. 1 and 2*a*) while being careful not to crease or rupture the roll tensioner.

Costs associated with the subject roll tensioner generally depend on the method of manufacture, the number of parts per foot, rate (speed) and fluctuating raw material prices. The material used to form the roll tensioner may be FDA compliant if required for food product use. Some methods can reuse a percentage of recycled material in the raw material mixture which will affect the material costs as well. If tooling already exists for the shape required, there would be less up-front investment cost. This translates into less risk. A new product idea could be brought to market with low risk and rapidly due to an inexpensive part cost and low upfront investment cost. This would be a low-cost improvement to packaging that adds value and ease of use. The roll tensioner would be a desirable benefit to the end-user or customer. The roll tensioner would be a marketing option and sales tool that would provide product differentiation, and unique packaging that stand out with respect to other wrapping material containers using standard packaging. There is also a safety concern for wrapping material manufacturers to consider, as mentioned above. While using conventional wrapping packages, cuts, scrapes or abrasions to the hands and fingers are significantly reduced, since the user no longer needs to search around the bottom of the box, struggling to grab the edge of the wrapping material. These structural and functional features and the advantages they afford provide valuable marketing themes for the manufacturer.

FIG. 1 illustrates a side plan view depicting a troublesome problem with conventional wrapping material containers, shown generally at 10, which is solved by the subject roll tensioner. After a section of the wrapping material is removed or cut from the wrapping material roll 11 in box 12 via metal cutter strip 13 the remaining wrapping material end 14 drops to the bottom 15 of the box 12. As a result, the end-user must reach his/her fingers down into the box 12 to retrieve the wrapping material end 14 before next using the wrapping material. When doing so, the end user's fingers are subject to cuts or injury from the remaining wrapping material end 14, or from the metal cutter strip 13. In order to remedy this problem and provide a solution in the art and an improvement of wrapping material boxes, the subject roll tensioner is provided.

The conventional box 12 (frequently household cardboard cutter box style dispensers) typically contains perforated tabs 12' on each end that are appointed to be dented inward by the end-user to retain the wrapping material roll within the box 12. Tabs 12' are designed to prevent the roll from pulling out of the box, but the tabs 12' do not prevent the material roll from sliding to and fro in the box. Nor do tabs 12' control the rolling of the material roll. Because the standard box tabs 12' push in from the bottom (e.g. perforated "U" shape tab), not the top, they "give" and allow the roll to slide back and forth inside the box. This problem becomes more evident as the roll diminishes in diameter. The original problem attending maintenance of an easily accessible cutting edge of the wrapping material still exists whether tabs 12' are used or not. The tabs 12' do not prevent the wrapping material roll from sliding to the back of the box, as shown for example in FIG. 1. Tabs 12' only prevent the wrapping material roll from being pulled up and out of the box as the material is removed from the roll.

These tabs are typically in conventional household cardboard cutter box style dispensers, while commercial cardboard cutter box style dispensers are generally more sophisticated. As an example See: https://www.webstaurantstore.com/choice-18-x-500-food-service-standard-aluminum-foil-roll/12218X5ST.html. Typically, a commercial cardboard cutter box style packaging is marketed toward commercial kitchens and the wrapping material roll in this example is positioned in the box opposite of household boxes. This would appear to still have a problem, just in the opposite direction as the roll diminishes in diameter. So, the subject tensioner could be installed on the back wall if the wrapping is installed in the opposite position.

Figure 2A:
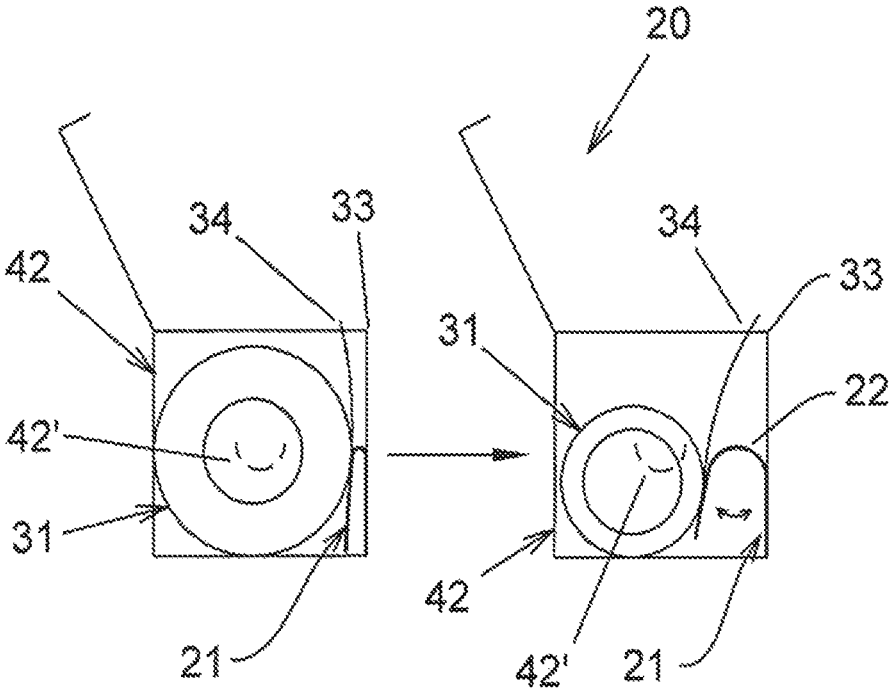
FIG. 2*a* illustrates a side plan view of the subject roll tensioner which solves the problem in the art.

FIG. 2*a* illustrates a side plan view of the subject roll tensioner, shown generally at 20, which solves the aforesaid problem in the art. As shown in FIG. 2*a*, in operation the subject roll tensioner 21 works by employing a gentle bend under constant tension (shown at 22), against a wrapping material end 34 positioned within a box 42. Box 42 typically contains perforated tabs 42' appointed to be dented inward by the end-user to prevent the roll from pulling out of the box. The tabs 42' do not prevent the wrapping material roll from sliding to the back of the box, as shown for example in FIG. 2*a*. Tabs 42' only prevent the wrapping material roll from being pulled up and out of the box as the material is removed from the roll. As the overall diameter of the wrapping material roll 31 diminishes over time, the subject roll tensioner 21 gentle bend continues to assert tension 22 on the roll 31, thereby maintaining the wrapping material end 34 upward and away from the front wall of the box, thereby creating a gap between the front wall of the box 42 and the roll of wrapping material.

This maintains the cut area/wrapping material end 34 of the wrapping material 31 parallel with, or in some instances, above the metal cutter strip 33. The roll tensioner 21 will not allow the remaining wrapping end 34 to drop down to the bottom of the box 42 after each use. By preventing the wrapper end 34 from dropping down to the bottom of the box 42 the user no longer will need to search around the bottom of the box 42 struggling to grab the edge of the wrapping material end 34, thereby avoiding cuts, scrapes and abrasions to the hand and fingers.

Figure 2B:
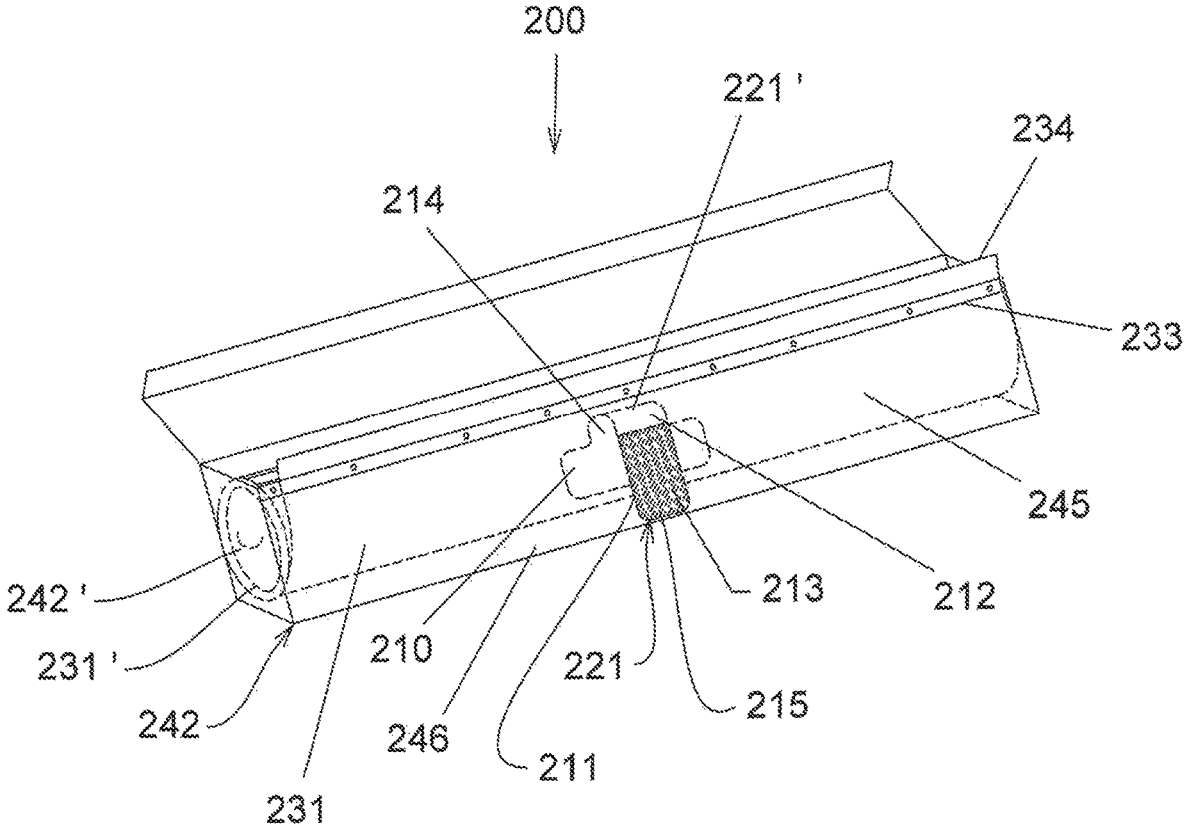
FIG. 2*b* illustrates a top plan view of a conventional household wrapping material box with an embodiment of the subject roll tensioner inserted therein.
Figure 3A:
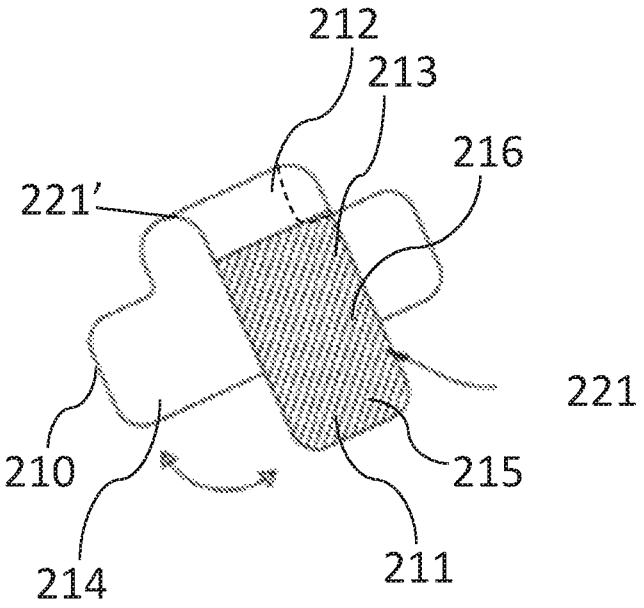
FIG. 3*a* illustrates a top side view of the roll tensioner of FIG. 2*a*-2*b*, showing the roll tensioner in a reversion or spring back configuration.
Figure 3B:
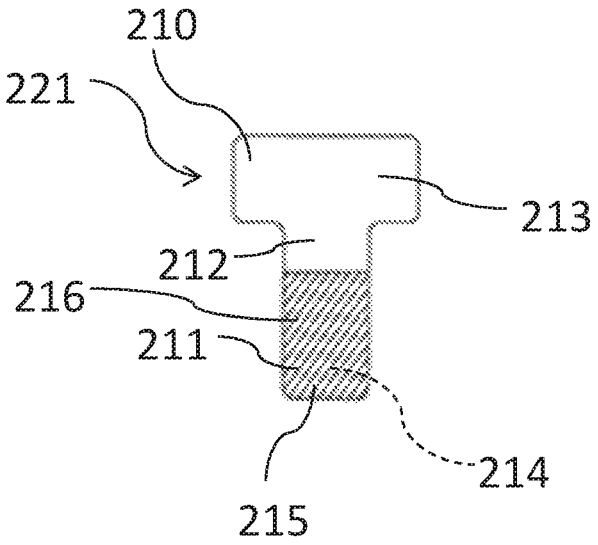
FIG. 3*b* illustrates a top plan view of the roll tensioner of FIG. 3*a;*
Figure 3C:
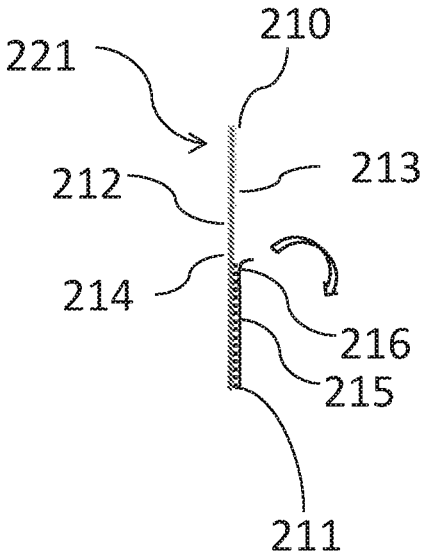
FIG. 3*c* illustrates side plan view of the roll tensioner of FIG. 3*a;*

FIG. 2*b* illustrates a top plan view of a conventional household wrapping material box, shown generally at 200, with the roll tensioner embodiment of FIG. 2*a* inserted therein. FIGS. 3*a*-3*c* illustrate top side, top plan and side views of the roll tensioner of FIGS. 2*a*-2*b*, showing the roll tensioner in a reversion or spring back and flat configurations, respectfully. An embodiment of a roll tensioner 221 of the subject invention is attached within a conventional household wrapping material box 242 (such as standard cardboard or other types of containers, including re-usable polymeric, aluminum or metal boxes are contemplated for housing a wrapping material roll). This conventional box 242 acts as packaging, as well as a dispenser for a wrapping material roll having a wrapping material 231 spooled on a tube (or core) 231'. A non-limiting example would be an aluminum foil cardboard box purchased at a retail grocery store. A household consumer would use the wrapping material as needed, while the remaining wrapping material is stored in the same box (or packaging/dispenser) for future use. The box 242 can be continually used for both storage, as well as a dispenser, until the entire roll of wrapping material 231 is depleted. At which time the box 242 would be discarded or recycled. The conventional box 242/packaging/dispenser, often contains an attached metal strip 233 (metal cutter strip) with a jagged edge. The purpose of the metal cutter strip 233 is to allow the user to cut the wrapping material 231 in a straight line, away from the remaining portion of the roll, to the length required by the user yielding a wrapping material end 234. The conventional household box 242 also contains perforated tabs 242' on each end of the box 242 which can be used by the end-user, to retain the wrapping material roll within the box 242. It is noted that tabs 242' prevent the wrapping material roll from being removed from the box. However the tabs 242' do not restrict to and fro movement of the wrapping material roll within the box 242. This can be accomplished by the user pressing the tabs from the outside-in on each end, taking care to make sure the tab extends into the inside diameter of the tube (or core) 231' of the wrapping material 231 spool. Often people are unaware that these tabs 242' are part of the cardboard box 242 and, in any event, their presence does not affect the use of the wrapping material 231. The subject roll tensioner 221 is designed to work either way, with or without, the box 242 tabs 242' being utilized.

Commercial wrapping or foil dispensers (permanent dispensers) do exist and are a separately purchased item from the conventional cardboard household consumer packaging. Examples of permanent dispensers can be found for example at:

https://www.webstaurantstore.com/edlund-ffd-18-stainless-steel-film-and-foil-dispenser-cutter-for-12-and-18-rolls/333FFD18.html?utm_source=Google&utm_medium=cpc&utm_campaign=GoogleShopping&gclid=CIK98b6y0dQCFY1LDQodiqoG7Q and also:

https://www.webstaurantstore.com/tablecraft-kk3-kenkut-3-12-18-film-and-foil-dispenser-cutter/808KK3.html However, for the household consumer, a separate dispenser would require an additional monetary investment beyond the purchase price of the wrapping alone. The regular household consumer would also need additional space to store the purchased dispenser. That additional storage space would either take up valuable counter space, wall space or cabinet volume. Both constitute precious real estate in most home kitchens. Marketing of these types of dispensers is generally directed toward commercial kitchen use. In any event, the subject tensioner, optionally, can be used in a permanent dispenser or a commercial size cardboard cutter box, as well as a household conventional dispenser (as discussed above).

Preferably, the roll tensioner 221 is composed of a thin, flexible clear material, such as Polyvinyl Chloride (PVC), and has a thickness of about 15 mm or 0.015 inches. Roll tensioner 221 is constructed having distal and proximal end sections, 210 and 211, separated by a spring back/reversion section 212, and formed having a first side 213 and a second side 214. A thin, flexible, pressure-sensitive, permanent adhesive tape 215 with a removable backer or tab 216 (see FIGS. 3*a*-3*c*) is applied on at least a portion of the proximal end section 211 on first side 213. Distal end 210 extends downward via spring back/reversion section 212 in the interior of box 242. Proximal end section 211 is attached via adhesive tape 215 to the center of the front inside wall 245 of box 242 under and perpendicular to the metal cutter strip 233 (first having the backer 216 removed from the adhesive tape 215). Metal cutter strip 233 can be attached to both the inside and more commonly, the outside of box 242, depending on the box 242 supplier. The position of the metal strip 233 is often presented on the outside of the box, but the subject tensioner is not hindered by the metal strips location. These metal strips are quite thin and are typically installed above the operating zone of the subject roll tensioner. The roll tensioner 221 is mechanically bent over as shown at 221' owing to the spring back/reversion section 212 as the wrapping material 231 roll is placed into the box 242, setting the roll tensioner 221 into the correct position so that the wrapping material end 234 rests upward. The roll tensioner 212 holds the edge/wrapping material end 234 upward and away from the front box 242 wall 245, thereby creating a gap between the wall 245 and the roll of wrapping material end 234. This makes it easier to grab the wrapping material end 234. The term "mechanically", as referred to herein means the bending of the tensioner due to the application of force, including installation by way of: (i) a machine which mechanically bends the tensioner and is machine inserted within a box with a wrapping material roll; or (ii) by way of manual application, through a human operator physically bending the tensioner while attaching the tensioner within a box and reinserting the material wrapping roll. The length of the roll tensioner is adequate to reach the bottom corner of box 242 as shown at 246. The length of the roll tensioner preferably ranges from about 2 inches to 8 inches (depending on the box size or box material; note the tensioner can readily be cut or stamped to fit specific box sizes). The subject tensioner design can be adjusted to compensate for box construction. i.e. a rigid box might need a longer tensioner to make up for the lack of "give" in the box wall.

Figure 4:
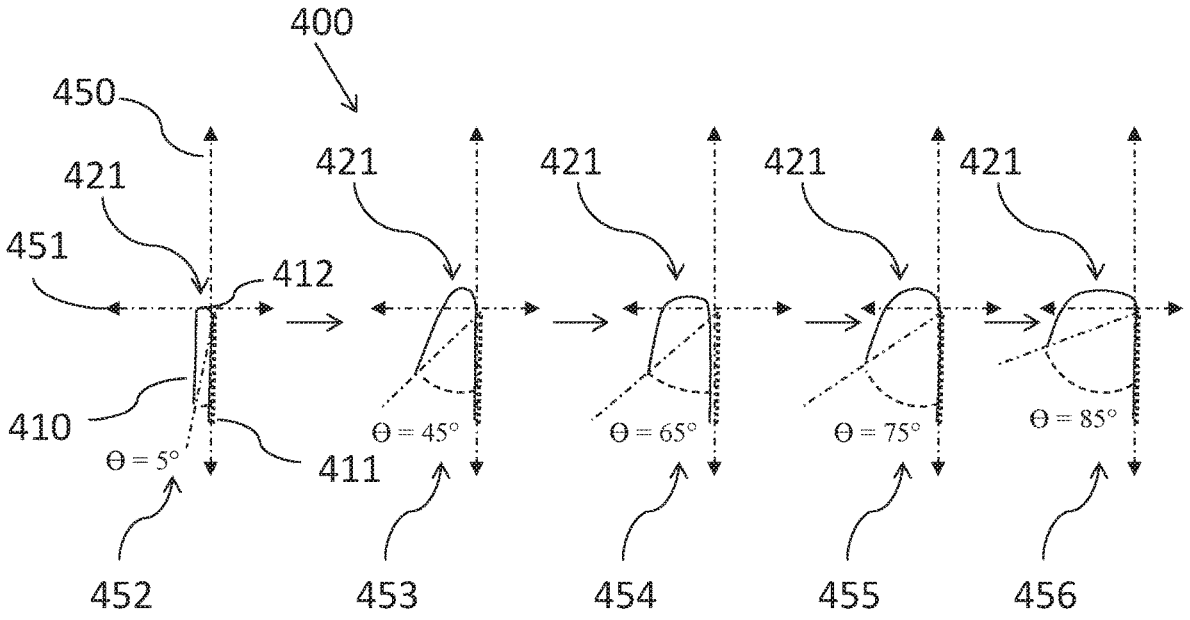
FIG. 4 illustrates reversion and flexing angles of the spring back reversion section from a vertical plane.

FIG. 4 illustrates reversion and flexing angles of the spring back reversion section from a vertical plane, shown generally at 400. The roll tensioner 421 is shown attached on a front wall of a conventional household wrapping material box via adhesive on proximal end 411. Different force and static tension are applied against the distal end 410 and spring back reversion section 412, respectively. Without being bound by theory, "tension" herein refers to a force in lbs. when a material is pulled, compression being the opposite. Static "Load", without being bound herein, would be the roll pushing up against the tensioner and compressing the tensioner. A reduction in the applied load results as the roll diameter diminishes. Herein, both situations occur in opposite directions. A "load" is being applied to the part and "spring tension" is in the opposite direction applying the stored mechanical energy as it returns to its original shape over time. For example, a spring is an elastic object used to store mechanical energy.

The static tension is a result of the roll of wrapping material—the more wrapping material loaded on the roll, the greater in diameter the roll is, and therefore the greater the static tension as the force pressing against the distal end 410 is greater causing the spring back reversion section 412 to be at a greater flex angle. Conversely, as the wrapping material is used off the roll and the wrapping material roll becomes reduced in diameter, the force against the distal end 410 decreases and the static tension of the spring back reversion section 412 results in a lesser flex angle. Preferably, the spring back reversion section 412 is capable of reversion and flexing at an angle $\Theta$ ranging between about 5°-85° from a vertical plane, herein shown at 450 (the horizontal plane is shown herein at 451). When the wrapping roll has a larger diameter dimension, owing to a large amount of wrapping material spooled thereon, the force against the distal section 410 is great and flex angle of the spring back reversion section 412 is less, for example, $\Theta$=~5° from the vertical plane 450 and the front wall of the wrapping material box, such as shown at 452. As the wrapping material is used, the wrapping roll diameter decreases, and the force against the distal section 410 decreases, along with the flex angle of the spring back reversion section 412 angle becoming greater. For example, see $\Theta$=~5°→$\Theta$=~45°→$\Theta$=~65°→$\Theta$=~75°→$\Theta$=~85° (as when the roll is nearly empty of wrapping material), shown at 452, 453, 454, 455, and 456, respectively.

The term "reversion" as used herein refers to a dimensional change in plastics products or viscoelastic materials as a consequence of "material memory". Original formed shapes of plastic products are "memorized" so that if it is subsequently distorted, it will return to its original shape. The stress/strain response for PVC (like other thermoplastic materials) is dependent on both time and temperature. As a plastic material is applied with a constant static load, there is created an immediate elastic response and the shape is fully recovered immediately when the load is removed. Additionally, a slower deformation continues while the load is applied, until rupture occurs. This is referred to as creep. Removal of the load before failure results in recovery of the original dimensions gradually over time. Temperature also influences the rate of creep and recovery. Creep rates typically increase at higher temperatures. Preferably, the roll tensioner has a "T" shape; however, a rectangular shape provides another preferred shape embodiment. Other shapes that include the same structural and functional parameters are contemplated.

Preferably, the roll tensioner 221 is constructed with a smooth surface and a low coefficient of friction material, such as PVC. PVC generally shows excellent performance under abrasive conditions. The main properties contributing to this are the low elastic modulus and coefficient of friction. This enables the material to "give" and particles tend to skid rather than abrade the surface. Materials for constructing the subject tensioner include low friction materials having flexibility properties that allow flexure of the tensioner and resiliency that provide for spring back without breakage. Representative materials include materials generally having a low coefficient of friction, such as for non-limiting example, Teflon, Nylon and Polyurethanes. The thickness of the tensioner is also a consideration when selecting materials used to construct the subject tensioner. The material forming the tensioner's spring back/reversion section should demonstrate adequate flexibility to deform elastically and return to its original shape when the applied stress (wrapping material) is removed. "Stress" is a measurement in PSI of the amount of force per area the tensioner material suffers when bent or pulled. It is also noted that the material construction of the box wherein the tensioner is mounted can have an effect on the flexibility and/or thickness of the tensioner. In cases where the box is composed of cardboard, the walls of the box may give to a degree so that the stress on the tensioner is dissipated proportionally. When the box is made of a rigid material, such as plastic or metal, the walls of the box are less likely to give and the stress on the tensioner will be greater. Thus, the tensioner material, length and/or thickness may be adjusted to counteract the material of which the box is composed.

Preferably, the subject tensioner is composed of PVC because it exhibits high hardness and mechanical properties especially well suited for its construction. The mechanical properties of rigid PVC (uPVC) are very good; the elastic modulus can reach 1500-3,000 MPa. Materials having properties similar to the empirically preferred PVC, are excellent candidates for construction of the subject tensioner. A table generally comparing mechanical properties of other materials to PVC is set forth below.

| | TS | FS | FM | CF |
|---|---|---|---|---|
| Nylon 6 Natural | 12,500 | 15,500 | 420,000 | 0.22 |
| PET-Tecapet ® | 12,500 | 17,600 | 430,000 | 0.25 |
| PTFE | 4,000 | | 72,000 | 0.1 |
| PVC | 7,500 | 12,800 | 481,000 | 0.3 |
| Polyester (thermoplastic) | | 14,500 | 362,594 | 0.3 |
| Polyurethane | 6,570 | 11,800 | 390,000 | 0.7 |

TS = Tensile Strength (PSI)
FS = Flexural Strength (PSI)
FM = Flexural Modulus (PSI)
CF = Dynamic Coefficient of Friction per ASTM D3702

Found at:
http://www.plasticsintl.com/sortable_materials.php; and
http://www.efunda.com/materials/polymers/properties/polymer_datasheet.cfm?MajorID=P-TP&MinorID=1

The preferred range for the value of the dynamic coefficient of friction is between 0.10 and 0.30. Polyurethane has more than twice the coefficient of friction of the other materials; therefore its use in the subject tensioner spring back reversion section is limited. Relative to the Flexural Modulus, a material with at least 350,000 PSI is preferable. The flexural strength of PTFE (Teflon) ranges from 72,000 to 190,000 PSI depending on the type of fill used but is still half of the comparable values of the other contenders. Found at http://catalog.wshampshire.com/Asset/psg_teflon_ptfe.pdf. The subject tensioner is preferably composed of a PVC material or other materials having comparable properties to PVC, as the collective presence of these properties is especially well suited for construction and prolonged use of the tensioner.

Economics, however, are a major factor, and PVC's performance in the context of wear rate/unit cost is excellent. The Low Coefficient of Friction works well in this application so that the wrapping material slides effortlessly and without any hang-ups over the roll tensioner's surface, even under load. The pressure-sensitive adhesive backer 216 applied to the roll tensioner is of an adequate strength to permanently attach to the box and hold the roll tensioner 221 to the box while bent into the fully installed position and remain attached for continuous use as roll material is removed and the diameter of the roll material is reduced or replaced.

Figure 5:
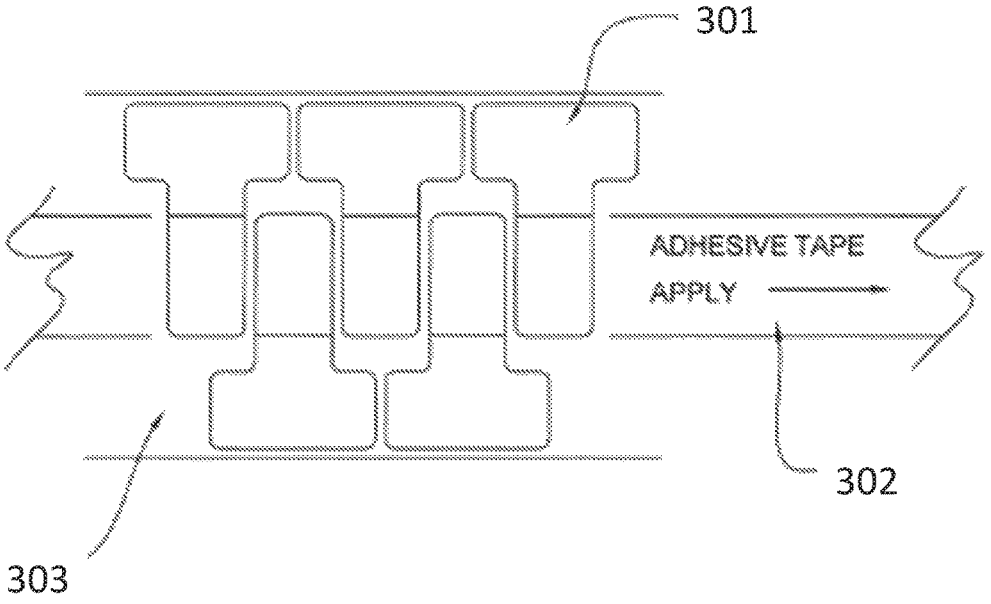
FIG. 5 illustrates a process for manufacturing an embodiment of the roll tensioner.

Referring to FIG. 5, a method of making or manufacturing the roll tensioner is proposed. The roll tensioner may be formed in sheets of material (such as PVC) through die-stamping with the application of adhesive tape with a peel backing. It is recognized that tooling would be required for sheet or strip forming as well as die-stamping and adhesive tape application (not necessarily in this order). Extruded sheets or strips of thermoplastic material, such as PVC, are die-cut or die-stamped into the required shape, herein shown at 301. Various manufacturing methods to accomplish this exist and may be used. Shapes 301 would be nested in an alternating pattern allowing the adhesive tape 302 to be applied in a continuous fashion (with backer attached) across alternating nested shapes, correctly positioned to cover all parts. The parts would then be removed from the main carrier sheet 303 leaving behind any excess material that is not needed. This excess material may be ground up and recycled.

Figure 6A:
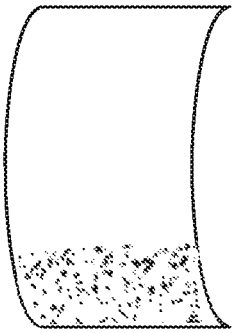
FIG. 6*a* illustrates an alternative embodiment of the subject roll tensioner shaped as a polygon.
Figure 6B:
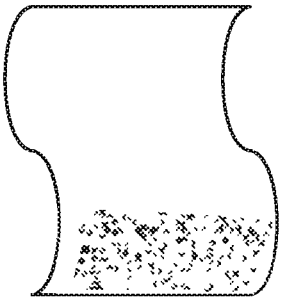
FIG. 6*b* illustrates an alternative embodiment of the subject roll tensioner shaped as a quadrilateral with at least one pair of parallel sides.
Figure 6C:
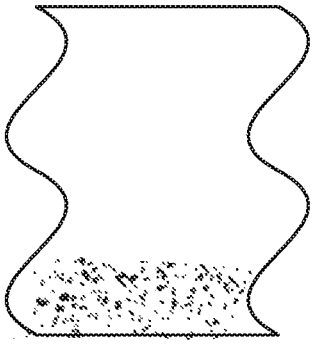
FIG. 6*c* illustrates an alternative embodiment of the subject roll tensioner shaped as a quadrilateral with at least one pair of parallel sides.
Figure 6D:
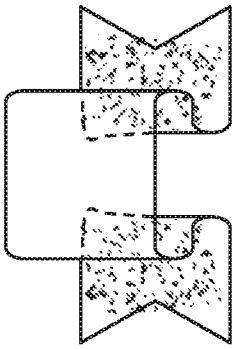
FIG. 6*d* illustrates an alternative embodiment of the subject roll tensioner shaped as a capital "U" wherein both the distal end and the proximal end include adhesive on the first side, so that that spring back reversion section is a flexible "U" shaped configuration.
Figure 6E:
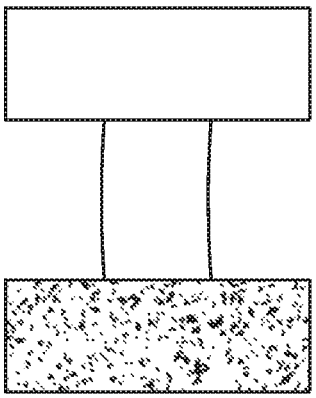
FIG. 6*e* illustrates an alternative embodiment of the subject roll tensioner shaped as a capital "I"

Referring to FIGS. 6*a*-6*e*, various alternative shaped configurations of the subject roll tensioner are shown. FIG. 6*a* illustrates an alternative embodiment of the subject roll tensioner shaped as a polygon. FIG. 6*b* illustrates an alternative embodiment of the subject roll tensioner shaped as a quadrilateral with at least one pair of parallel sides. FIG. 6*c* illustrates an alternative embodiment of the subject roll tensioner shaped as a quadrilateral with at least one pair of parallel sides. FIG. 6*d* illustrates an alternative embodiment of the subject roll tensioner shaped as a capital "U" wherein both the distal end and the proximal end include adhesive on the first side, so that that spring back reversion section is a flexible "U" shaped configuration that presses against the wrapping material roll cut edge. However, it has been found that this is not the preferred embodiment because it does not provide a free edge for following and guiding the wrapping material edge as with the other embodiments illustrated in FIGS. 6*a-c* and *e*. FIG. 6*e* illustrates an alternative embodiment of the subject roll tensioner shaped as a capital "I". In each illustration, the proximal end section is formed having a first side with a permanent adhesive applied, shown in the shaded region or regions (via FIG. 6*d*).

Figure 7A:
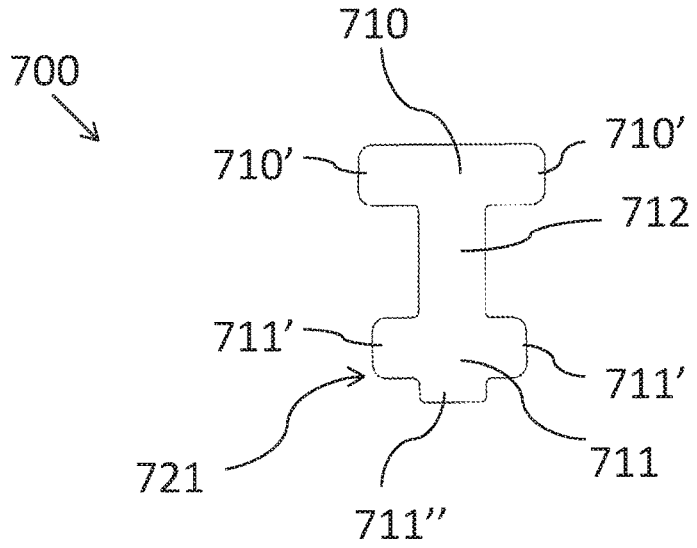
FIG. 7*a* illustrates a top plan view of another embodiment of the roll tensioner.
Figure 7B:
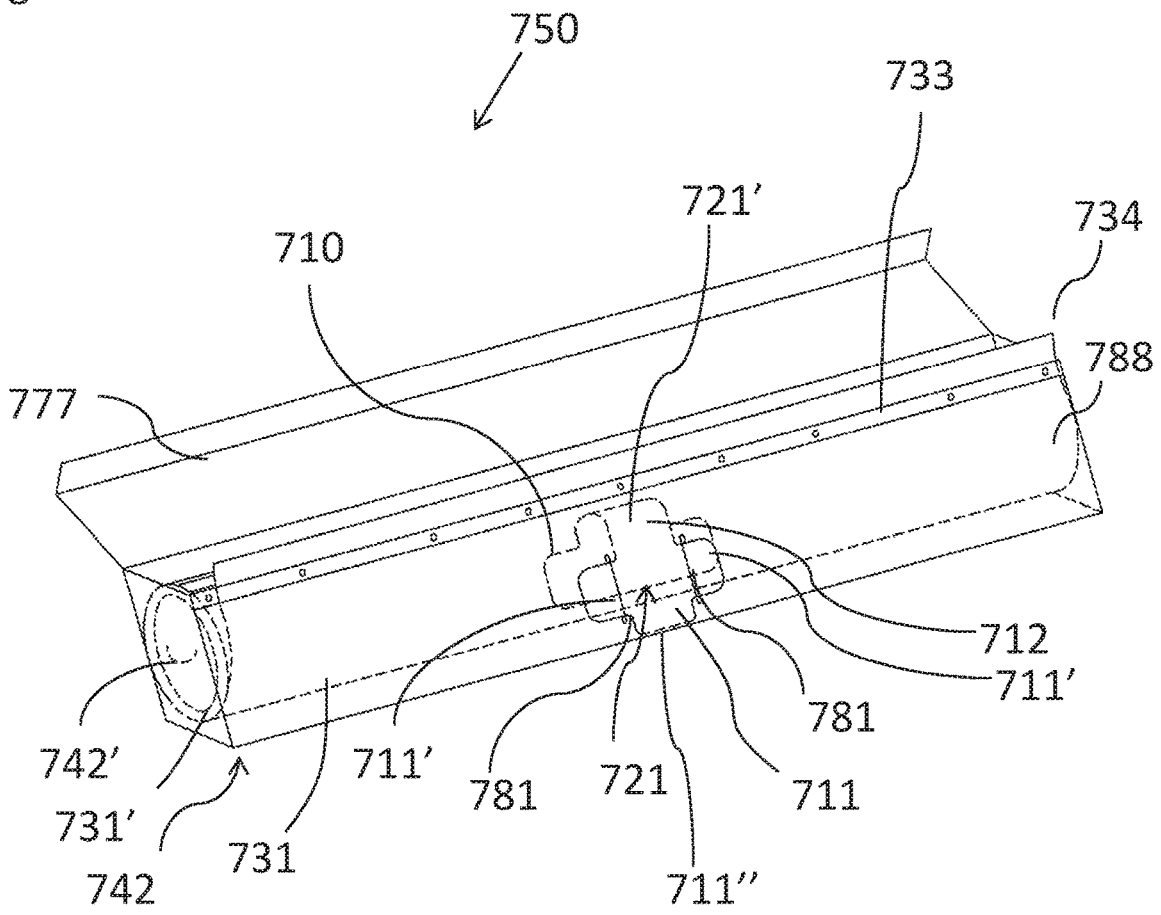
FIG. 7*b* illustrates a front top plan view of a wrapping material box with the roll tensioner embodiment of FIG. 7*a* inserted therein and the box lid open.
Figure 7C:
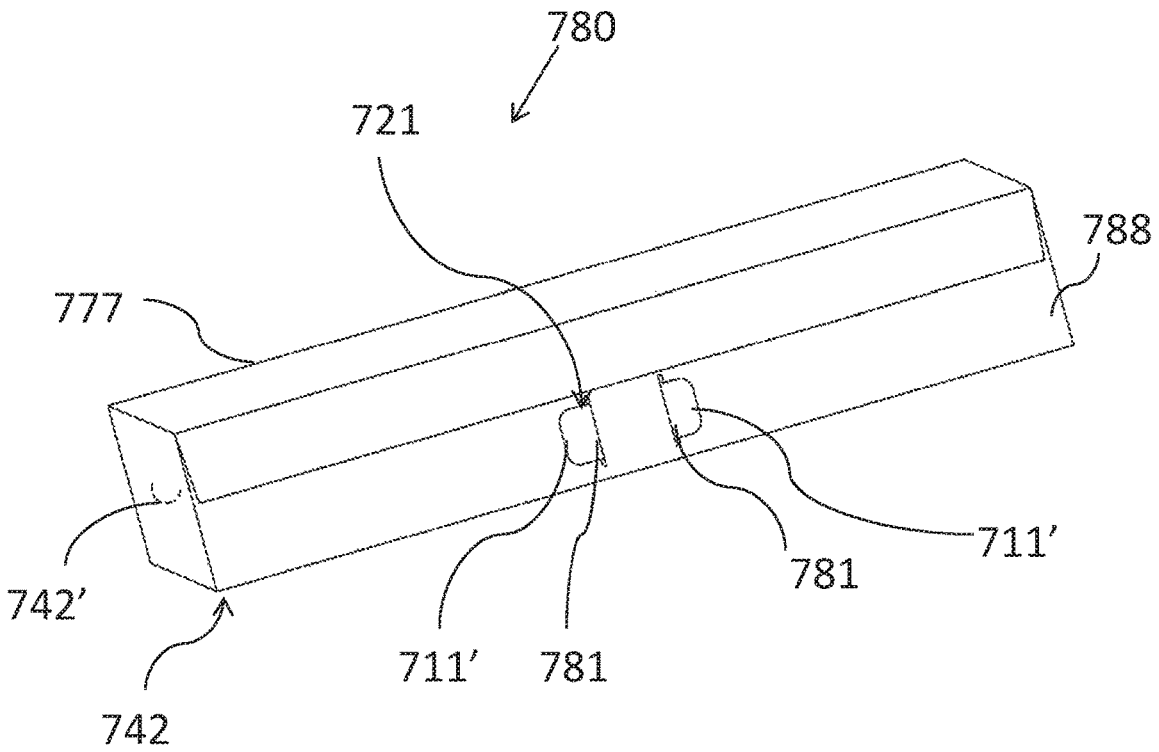
FIG. 7*c* illustrates a front top plan view of the wrapping material box with the roll tensioner embodiment of FIG. 7*a* inserted therein and the box lid closed.

FIG. 7*a* illustrates another embodiment of the roll tensioner, shown generally at 700. FIG. 7*b* illustrates a front top plan view of a wrapping material box, shown generally at 750, with the roll tensioner embodiment of FIG. 7*a* inserted therein and the box lid open. FIG. 7*c* illustrates a top plan view of the wrapping material box, shown generally at 780, with the roll tensioner embodiment of FIG. 7*a* inserted therein and the box lid closed.

Referring to FIGS. 7*a*-7*c*, in this embodiment the roll tensioner 721 is constructed having distal and proximal end sections, 710 and 711, separated by a spring back/reversion section 712. Proximal end section 711 includes opposing bottom tabs 711' and center bottom tab 711" (for stability) adapted to secure the tensioner 721 in place within a wrapping material box 742. Distal end 710 is adapted to extend downward via spring back/reversion section 712 in the interior of box 742 when a force is applied (i.e. the wrapping material roll). Preferably the distal end 710 includes opposing top tabs 710' forming a "T" distal end section thereby providing greater surface area for abutting a wrapping material end 734 or the area proximate thereto.

Roll tensioner 721 is attached within the wrapping material box 742 acting as packaging, and as a dispenser for a wrapping material roll having a wrapping material 731 spooled on a tube (or core) 731'. The box 742/packaging/dispenser, preferably contains an attached metal strip 733 (metal cutter strip) with a jagged edge yielding the wrapping material end 734. The conventional household box 742 may also contain perforated tabs 742' on each end of the box 742 which can be used by the end-user, to retain the wrapping material roll within the box 742.

Figure 8:
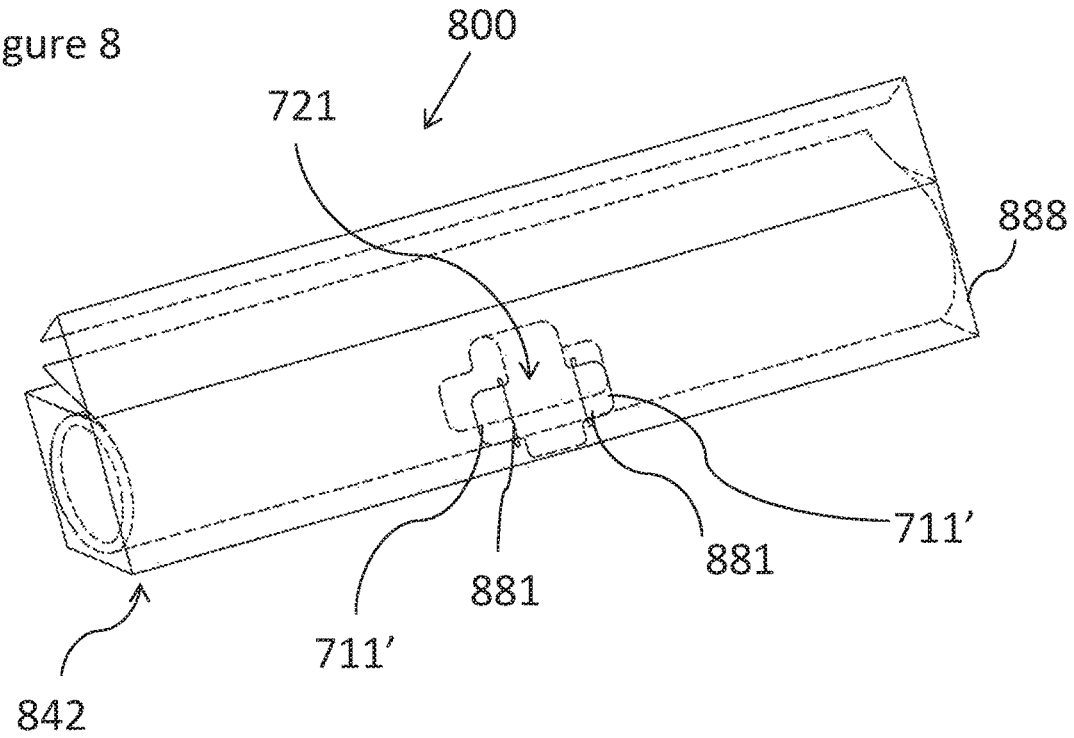
FIG. 8 illustrates the embodiment of the roll tensioner of FIG. 7*a* with attachment on the rear of a box rather than in the front of the box.

In this embodiment, roll tensioner 721 has no attachment means, i.e. no adhesive tape, but does require two vertical slots 781 in either the front or rear vertical wall of box, herein shown in the front vertical wall 788 (see FIG. 8, showing rear vertical wall of box configuration) for receiving opposing bottom tabs 711'. The bottom tabs 711' of the tensioner 721 flex and weave through the box slots 781, from within the box 742, to secure the tensioner 721 in place. The tensioner 721 is held correctly in position while under load from the wrapping material 731 and is prevented from being pulled up and out of the box 742 because the bottom tabs 711' prevent up and down movement once weaved through the slots 781. Slots 781 would also be helpful when correctly setting the position of the tensioner 721 in relation to the wrapping material 731. With an adhesive tape application, there is always a risk of the tensioner being slightly out of proper alignment or off the correct position. However, in this embodiment, there is no adhesive tape application and instead the tensioner is secured by way of the mating bottom tabs 711' and slots 781 in the box 742 to set the position of the tensioner 721. If the slots 781 are not vertical or are off-center, then the tensioner 721 will also be off. This embodiment will not affect the box's 742 lid 777 from closing, as the top lip of the box 742 would be above the tabs 711'. See FIG. 7*c* showing the box 742 with the lid 777 closed.

The roll tensioner 721 is mechanically bent over as shown at 721' owing to the spring back/reversion section 712 as the wrapping material 731 roll is placed into the box 742, setting the roll tensioner 721 into the correct position so that the wrapping material end 734 rests upward and away from the front box 742 wall 788, thereby creating a gap between the wall 788 and the roll of wrapping material end 734. This makes it easier to grab the wrapping material end 734.

FIG. 8 illustrates the embodiment of the roll tensioner of FIG. 7*a* with attachment on the rear of the box rather than in the front of the box, as in FIG. 7*b*. Other than the location of slots 881, the configurations of the tensioner and the box are the same. In this embodiment, roll tensioner 721 is constructed as set forth in regards to FIG. 7*a*, but the box's 842 two vertical slots 881 are shown on the rear vertical wall 888 of box 842 for receiving the opposing bottom tabs 711' of tensioner 721. The bottom tabs 711' of the tensioner 721 flex and weave through the box slots 881, from within the box 842, to secure the tensioner 721 in place.

Alternative features of the subject invention are contemplated and non-limiting including, for example: the roll tensioner may be constructed in a plethora of shapes and sizes, and from a plethora of materials and colors; etc. These features are contemplated in combination with the main embodiments shown in the Figures.

Figure 9A:
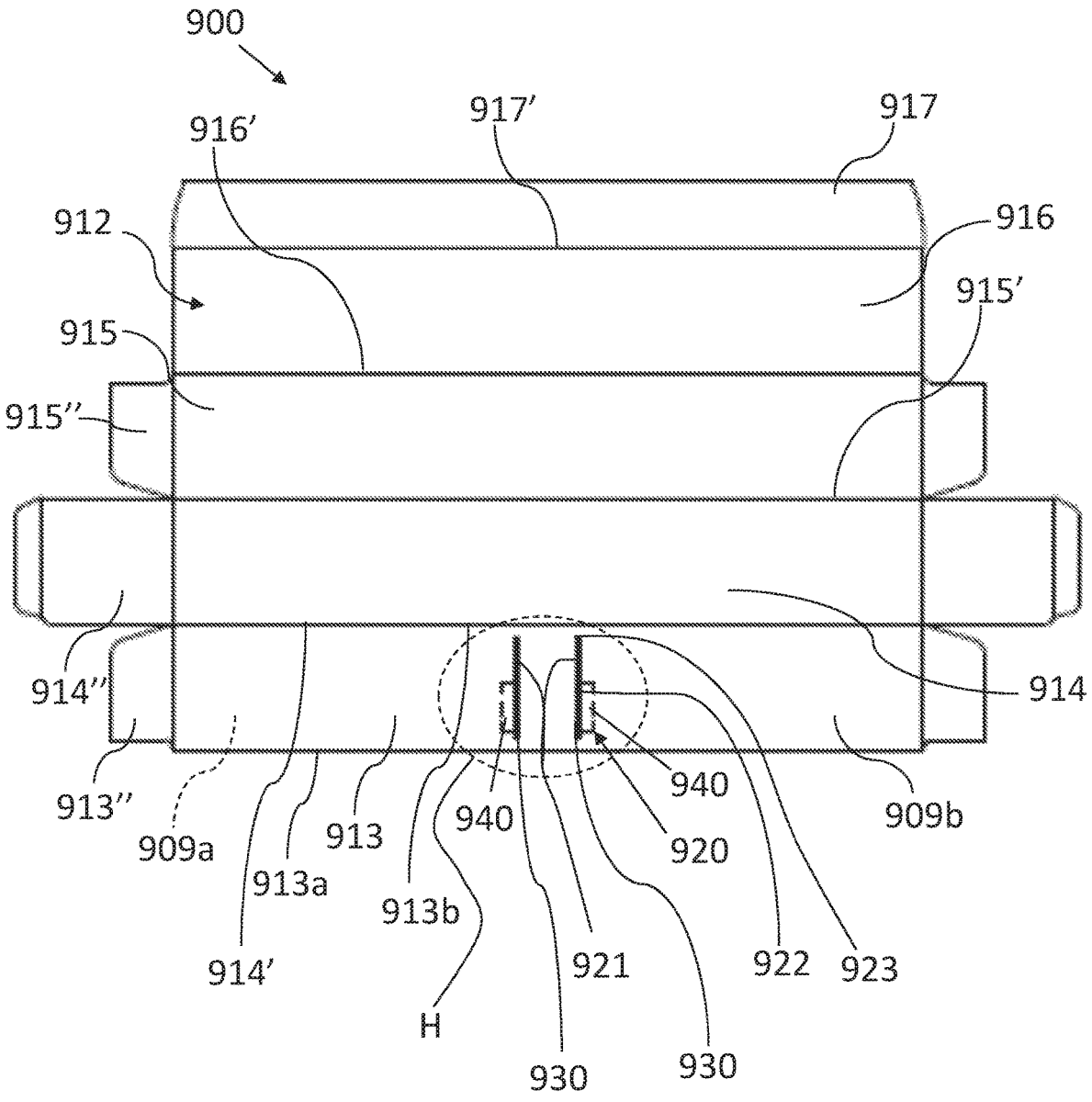
FIG. 9*a* illustrates Step 1 of an embodiment of the subject method for manufacturing a box assembly with a roll tensioner system, showing a top plan view of a wrapping foil/paper/material dispensing box flat or unfolded and a tensioner slide assembly die-cut stamped or formed into the unfolded box.
Figure 9B:
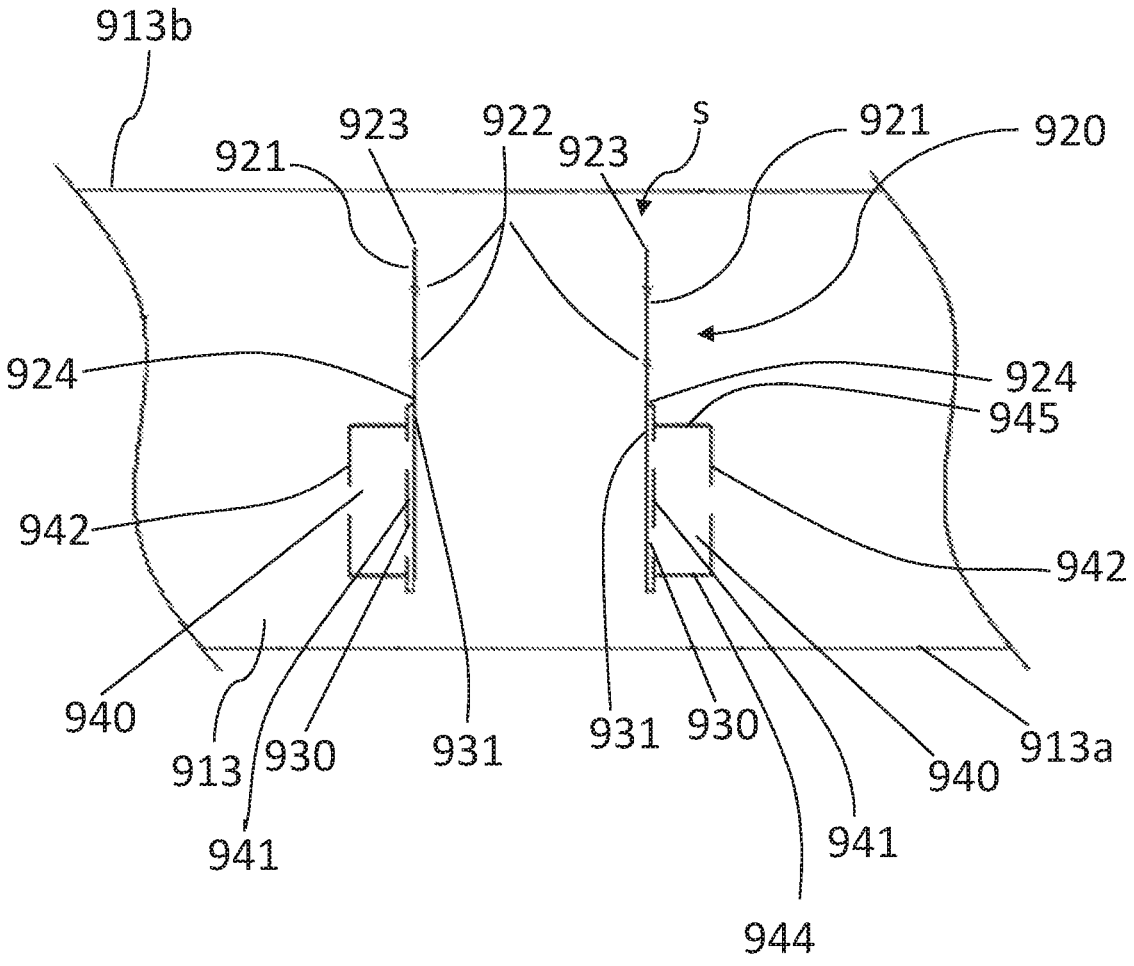
FIG. 9*b* is an enlarged view taken along H of FIG. 9*a;*

FIGS. 9*a*-9*i* illustrate an embodiment of the wrapping material roll tensioner system and method, with Steps 1-6 illustrating a wrapping material box configured from flat to assembled with a roll tensioner/tensioner inserted therein with a material roll ready for sale to an end-user or consumer. FIG. 9*b* is an enlarged view taken along H of FIG. 9*a*. Referring to FIGS. 9*a* and 9*b*, the subject system integrates the subject roll tensioner within roll dispensing boxes, particularly when using a tensioner having opposing bottom side tabs and no adhesive (as, for example, depicted in FIG. 7*a*-8). The subject figures illustrate a tensioner slide assembly which features two folding locking flaps that are appointed to lock the roll tensioner in place during manufacture and shipping and engaged when the roll tensioner is to be readied for first use. It is noted that the Steps of the method may be in sequence, or may be re-arranged to suit manufacturing needs.

FIG. 9*a* illustrates Step 1 of an embodiment of the subject method of manufacture of a box assembly with a roll tensioner system, wherein the wrapping foil/paper/material dispensing box is flat or unfolded and a tensioner slide assembly is die-cut stamped or otherwise formed into the unfolded box, shown generally at 900. In Step 1, a tensioner slide assembly is shown as a die-cut design stamped into a box for assembly. Box 912 is shown in a flat, unassembled configuration, having an exterior face and an interior face, 909*a* and 909*b*, respectively. Box 912 is constructed generally having a front wall 913 that abuts bottom wall 914 at bend line/fold line 914'. In turn, bottom wall 914 abuts back wall 915 at a bend line/fold line 915', which in turn abuts top wall 916 abutting top flap or closure flap 917, each separated by way of fold lines 916' and 917', respectively. Additionally, end flaps are provided on front wall 913, bottom wall 914 and back wall 915, each shown as 913", 914" and 915", respectively, which end flaps forming the sidewalls of the rectangular box 912 when the box 912 is formed.

FIG. 9*b* illustrates an enlarged view of a tensioner slide assembly 920 integrated in front wall 913 having two opposing parallel slits 921 extending through the front wall 913 of the dispensing box 912. Slits 921 are cut, sliced or formed in front wall 913 of box 912 as narrow slits or lines. As shown in FIG. 9*b*, parallel slits 921 are preferably formed as narrow cuts having one or more kiss cuts, cut-scores, nicks or connection points 922 adapted to breakaway when force, such as pressing by a user, is applied. Parallel slits 921 comprise a bottom end point 923 located a distance "s" perpendicular from a bottom edge 913*b* of front wall 913. Preferably, the distance "s" is at least ¼" (6.35 mm) from said bottom edge 913*b* of said front wall 913. Parallel slits 921 extend from said bottom end point 923 to a top end point 924 adjoining two opposing parallel slots 930. Two opposing parallel slots 930 adjoin parallel slits 921 extending through the front wall of the dispensing box. Parallel slots 930 share a primary assembly side wall 931 with the parallel slits 921. Two opposing parallel locking flaps 940 are integrated within the parallel slots 930, sharing a secondary assembly wall side 941 with the parallel slots 930. Locking flaps 940 are appointed to be deployed at a later time, such as when the consumer opens and uses the final wrapping material with tensioner system product. Locking flaps 940 are formed as parallel tabs abutting and flush with parallel slots 930 are appointed to fold at fold lines 942 when the system is in use. The locking flaps 940 have a flap height and the parallel slots 930 have a slot height, wherein the flap height is preferably less than the slot height.

The locking flaps 940 have a flap top wall 944 and flap bottom wall 945 that terminate at fold line 942. Flap top wall 944 and flap bottom wall 945 are adapted to break-away when a pressing force is applied later by an end user. Preferably, flap top and bottom walls, 944, 945, are formed as narrow cuts having one or more kiss cuts, cut-scores, nicks or connection points (not shown, but similar to cuts 922) adapted to breakaway when force, such as pressing by an end-user/user, is applied. When the locking flaps 940 are pushed outward, separating to break-away from the inside of the front wall 913 and pressed outward to bend at the bend wall/fold line 942 bending is facilitated without tearing. Locking flaps 940 are in the stored position (as shown, for example in FIG. 9*a*, 9*b*) prior to use and adapted to open to a locking position by an end-user (as shown, for example in FIG. 10*d*). The flap top and flap bottom walls 944, 945, break-away when pressing force is applied, and the locking flaps 940 are then appointed to be bent outward along the fold line 942 by an end-user.

Figure 9C:
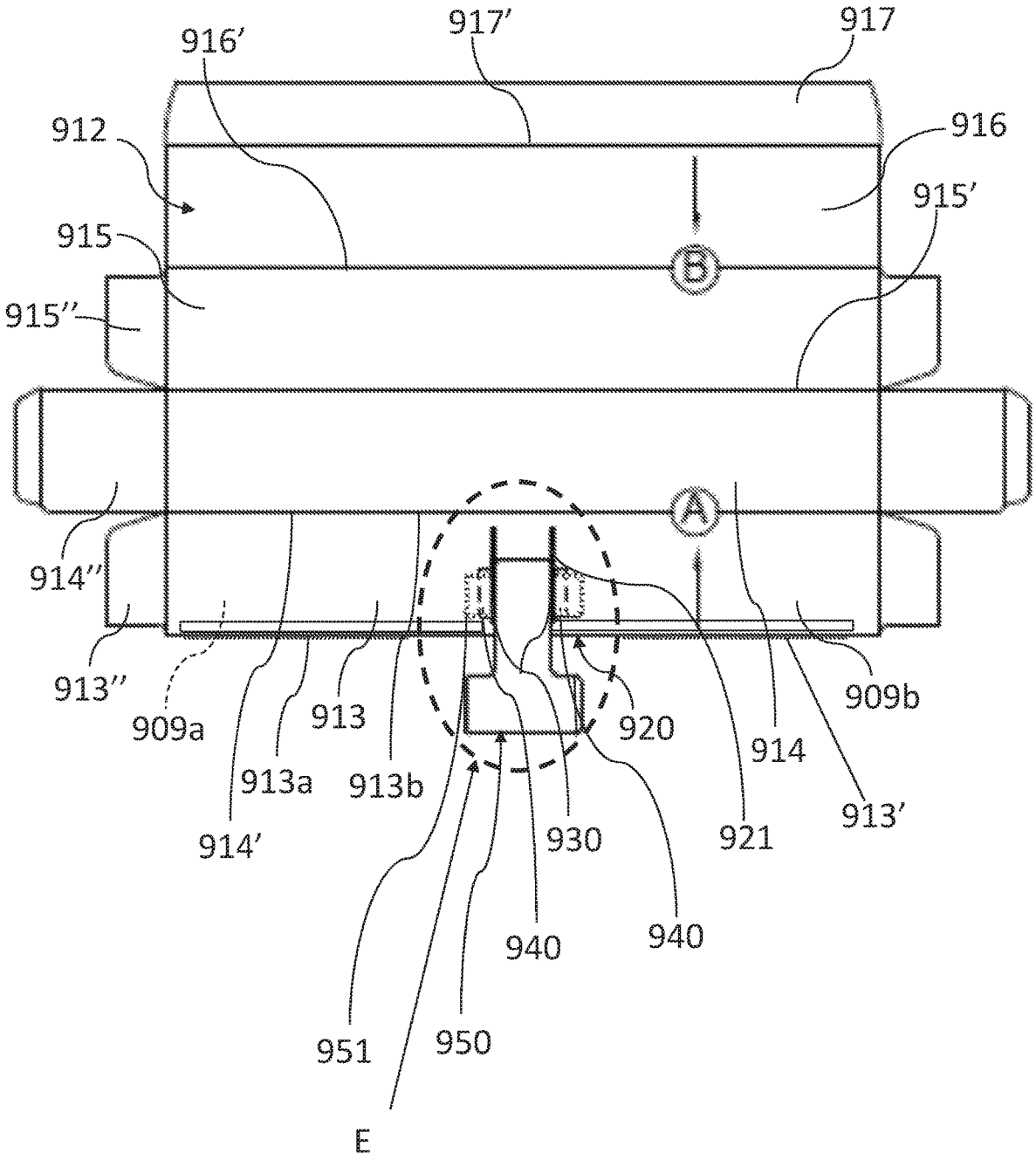
FIG. 9*c* illustrates Steps 2 and 3 of the method of manufacture, showing a top plan view of the flat box with affixation of a cutter strip on the top edge of the front wall of the dispensing box, followed by insertion of a roll tensioner.

FIG. 9*c* illustrates Steps 2 and 3 of the method of manufacture, showing a top plan view of the flat box with affixation of a cutter strip 913' on the top edge of the front wall 913 of the dispensing box, followed by insertion of a roll tensioner 950 (such as that shown in FIG. 7*a*, configured as discussed hereinabove) into parallel slots 930, first position, of the tensioner slide assembly 920. In Steps 1 & 2 of FIGS. 9*a* and 9*c*, the unfolded standard dispensing box 912 is customized with the tensioner slide assembly's 920 unique locking mechanism (slot and slit configuration)/locking flaps 940. Mounting side tabs/opposing bottom tabs 951 of the roll tensioner 950 are inserted from the interior side/face 909*b* of the box, into parallel slots 930 near the top edge 913*a*/near the serrated edge 913'. Preferably, the roll tensioner 950 includes indicia, logos or advertising designer or print, and when placed in the assembly, the printed side of the roll tensioner 950 is facing up and visible in reverse on the same side as the box interior (i.e. when the box is formed, via interior 909*b*). Subsequently, the box 912 is folded at bend or fold lines A and B to form the box 912 construct of Step 4 shown in FIGS. 9*d*, 9*e* and 9*f*, respectively. Preferably, first position of the roll tensioner comprises the opposing bottom tabs of the roll tensioner 950 located in parallel slots 930 when the roll tensioner is in non-use or disengaged for shipping. A second position of the roll tensioner results when the roll tensioner is slid downward so that the opposing bottom tabs of the roll tensioner rest within the parallel slits 921 the dispensing box for use or engagement.

In this embodiment of the roll tensioner 950 does not include adhesive tape for attachment to secure the tensioner 950 in the box, but instead the tension slide assembly 920 is utilized. The opposing bottom tabs 951 of the roll tensioner 950 flex and weave through parallel slots 930, from inside 909*b* of box 912, with locking flaps 940 to secure the tensioner 950 in place during use. The tensioner 950 is held correctly in position as it is slid downward from parallel slots 930 into parallel slits 921 and locked into place via engagement of locking flaps 940 (see FIGS. 10*a*-*b*). Downward movement of the roll tensioner 950 from the parallel slots 930 to the parallel slits 921 and engagement of the locking flaps 940 further facilitate correctly setting the position of the tensioner 950 in relation to the wrapping material in the box 912. The roll tensioner is adapted to rest in this position, referred to as a "first position", during non-use and is appointed to be slid down the parallel slots to the parallel slits into a "second position" when later engaged for use.

Figure 9D:
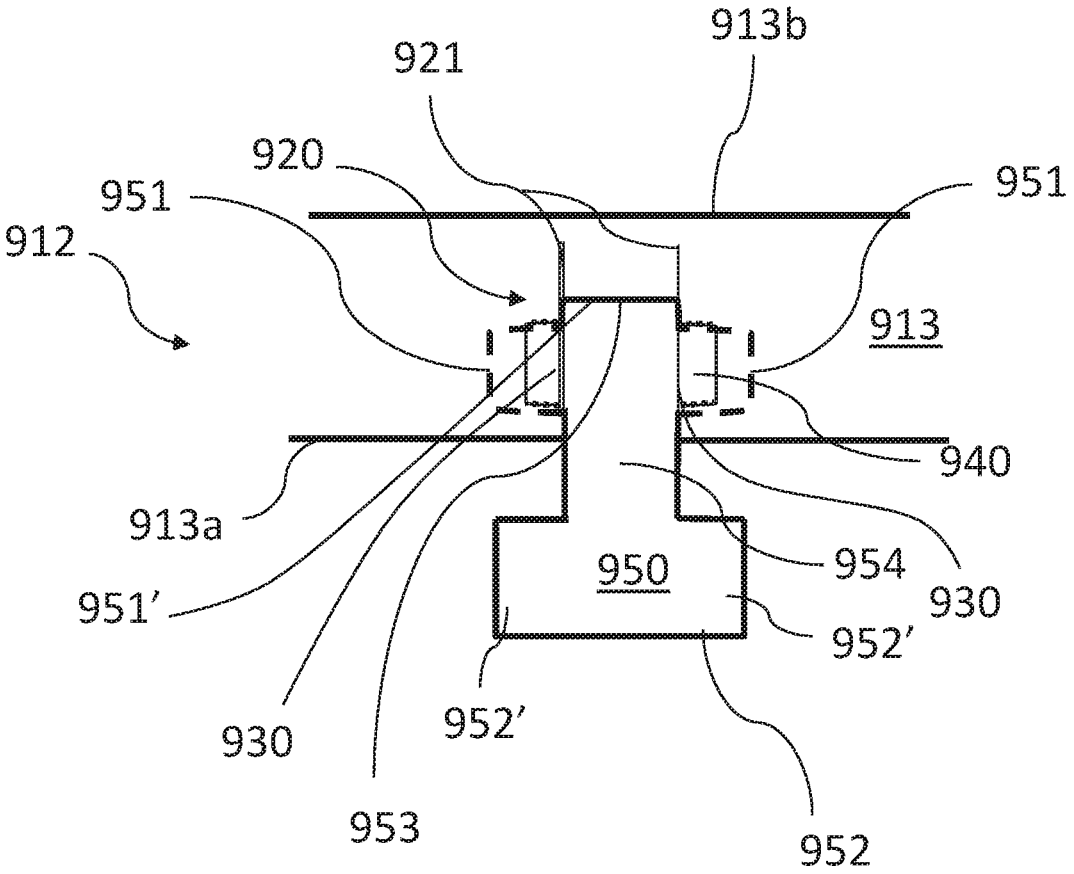
FIG. 9*d* is an enlarged view taken along E of FIG. 9*c;*

FIG. 9*d* is an enlarged view taken at E of FIG. 9*c*, showing the insertion of the roll tensioner 950 in the tensioner slide assembly 920 of the flat box 912. The roll tensioner 950 in the embodiment preferably is constructed having opposing bottom tabs 951 that flex and are inserted through parallel slots 930 to secure the tensioner 950 within the box 912 during manufacture and shipping. Roll tensioner 950 is constructed having distal and proximal end sections, 952 and 953, separated by a spring back/reversion section 954. Proximal end section 953 includes opposing bottom tabs 951 and center bottom tab 951' (for stability) adapted to secure the tensioner 950 in place within a wrapping material box 912. Distal end 952 is adapted to extend downward via spring back/reversion section 954 in the interior of box 912 when a force is applied (i.e. the wrapping material roll). Preferably the distal end 952 includes opposing top tabs 952' forming a "T" distal end section thereby providing greater surface area for abutting a wrapping material end or the area proximate thereto.

When inserted during assembly the opposing bottom tabs 951 are mounted in parallel slots 930 parallel to and abutting locking flaps 940 which are disengaged or still remaining unfolded on the box top wall 913. When the box 912 is formed and the roll inserted, the tensioner extends and bends to rests over the roll in the interior of the box until use (see FIGS. 10*a*-10*g* for operation of use).

Figure 9E:
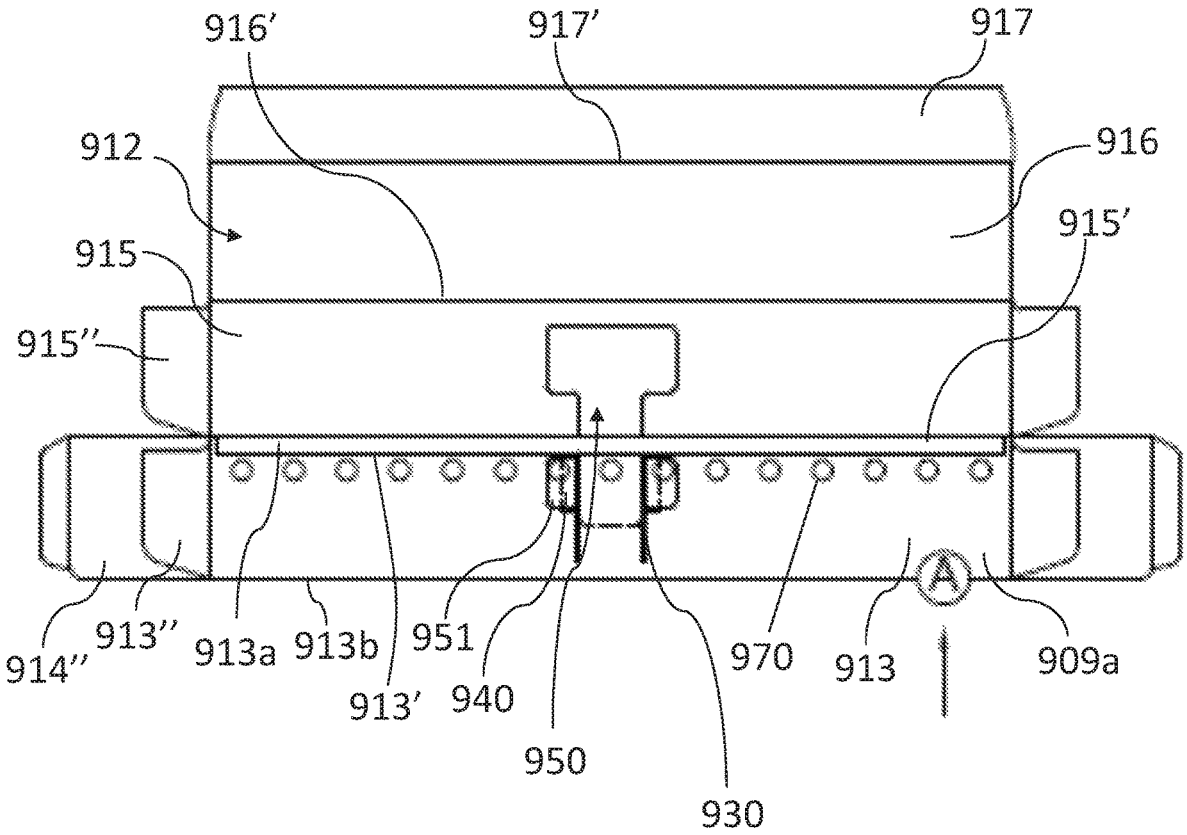
FIG. 9*e* illustrates Step 4 of the method of manufacture, showing a top plan view of the box with the serrated cut edge affixed, glue spots adhered, and the flat box folded at bend or fold line A.
Figure 9F:
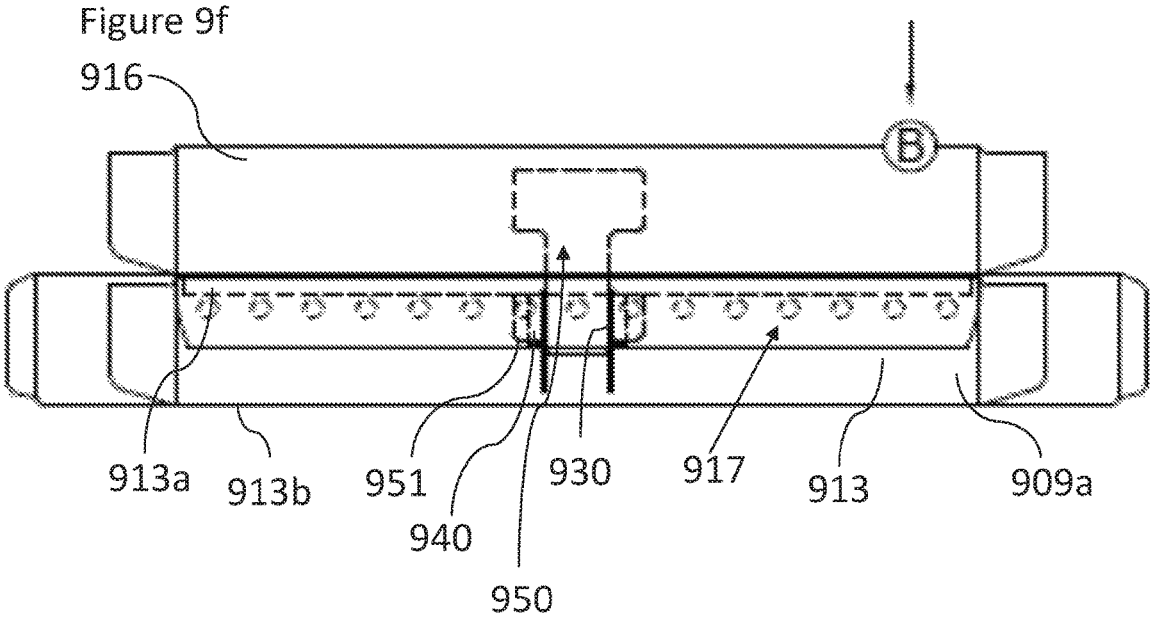
FIG. 9*f* illustrates continuation of Step 4 of the method of manufacture, showing a top plan view with the box folded at bend or fold line B.

FIG. 9*e* illustrates Step 4 of the method of manufacture, showing a top plan view of the box with the serrated cut edge affixed, glue spots adhered, and the flat box folded at bend or fold line A. FIG. 9*f* illustrates continuation of Step 4 of the method of manufacture, showing a top plan view with the box folded at bend or fold line B. Fold box orientation operation is carried out preferably on an automated packaging conveyer. In step 3 and/or step 4, the portion of box with the serrated edge 913' and the tensioner 950 is folded inward along bend or fold line/crease "A", towards the interior of the box 912 with the tensioner's 950 top side/distal end, preferably with a trademark, now oriented correctly so it is readable. Glue spots 970 are applied during the manufacturing operation, with the order of application being at any of the aforestated steps. The lid/top wall 916 of the box 912 is also folded inward along bend or fold line/crease "B" and glued to the side with the serrations and the box 912 partially sealed.

In Step 4, the dispensing box is folded at bend or fold lines between the front wall and the bottom wall and the back wall and the top wall with closure flap. Pressure is applied to the closure flap and adhering the closure flap to the front wall by way of glue spots applied below the cutter strip. It is noted that glue spots may be applied prior and proximal to the cutter strip on the front wall for adhering the closure flap to the front wall.

Figure 9G:
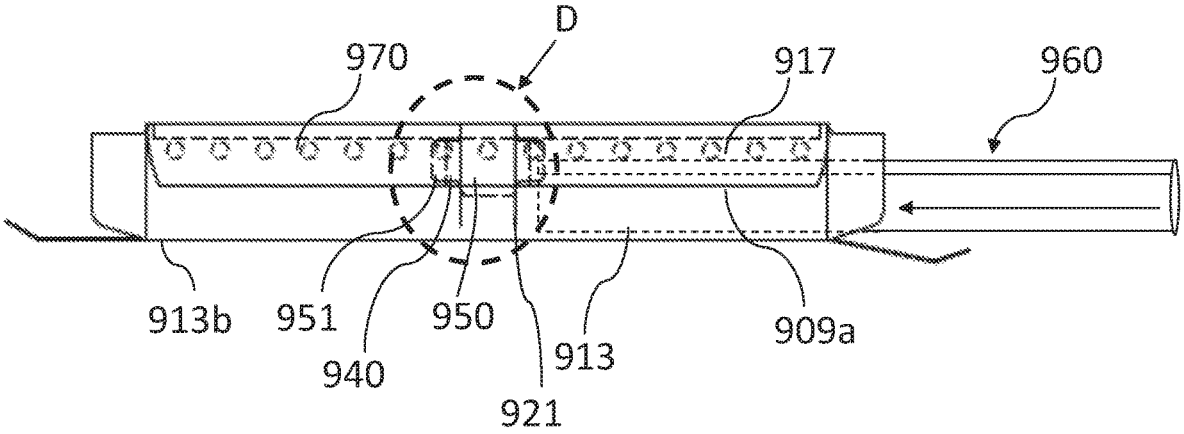
FIG. 9*g* illustrates Step 5 of the method of manufacture, showing a front view of the box expanded open with the material roll inserted.

FIG. 9*g* illustrates Step 5 of the method of manufacture, wherein box 912 is substantially assembled and, on the conveyor is brought to the roll, expanded so the box lid/box top 916 faces up, and the roll of material 960 (such as foil, parchment paper, wax paper, paper, etc.) inserted, generally by an insertion machine. In this position, the subject tensioner is inside the box 912 toward the top of slots 920' and is curved and snug against the interior 909*a* front wall 913 and lid/box top 916 of the box 912, allowing the material roll 960 to be inserted without any interference. The box 912 is then closed on both ends and proceeds to finish packaging. In Step 5, the material roll is inserted into the interior of the dispensing box. The roll tensioner rests in the interior of the dispensing box proximal to the top edge of the front wall in the parallel slots with its distal end curving over the material roll laying proximal to the interior of the top wall of the dispensing box.

Figure 9H:
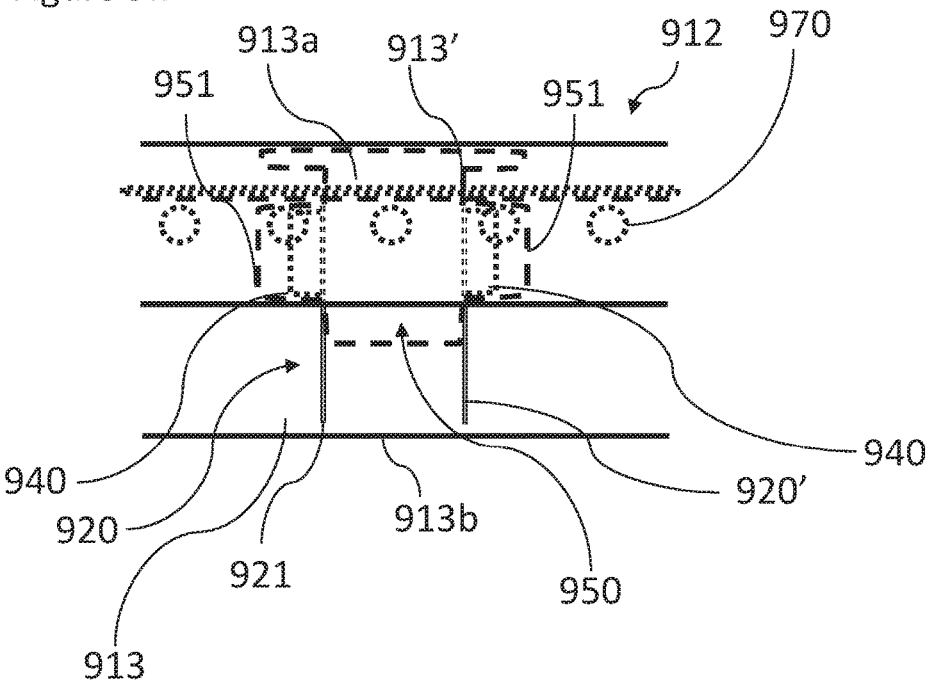
FIG. 9*h* is an enlarged view taken at D of FIG. 9*g;*

FIG. 9*h* illustrates an enlarged view taken at D of FIG. 9*g*, showing the roll tensioner 950, tensioner receiving slide assembly 920 with parallel slots 930 with locking flaps 940 and parallel slits 921. When the wrapping material box with tensioner is assembled, box 912 with front wall 913 includes roll tensioner 950 attached to the box 912 by way of the tensioner receiving slide system 920 integrated in front wall 913 through parallel slots 930 and later locked into place by way of sliding downward to parallel slits 921 and engaging locking flaps 940.

Figure 9I:
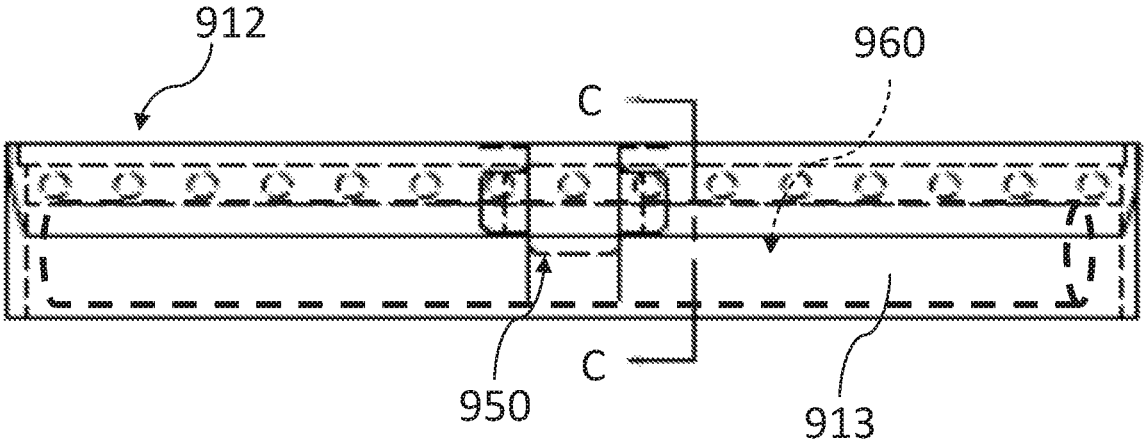
FIG. 9*i* illustrates Step 6 of the method of manufacture, showing a front view wherein the end walls of the dispensing box are closed, and the dispensing box readied for shipment.
Figure 9J:
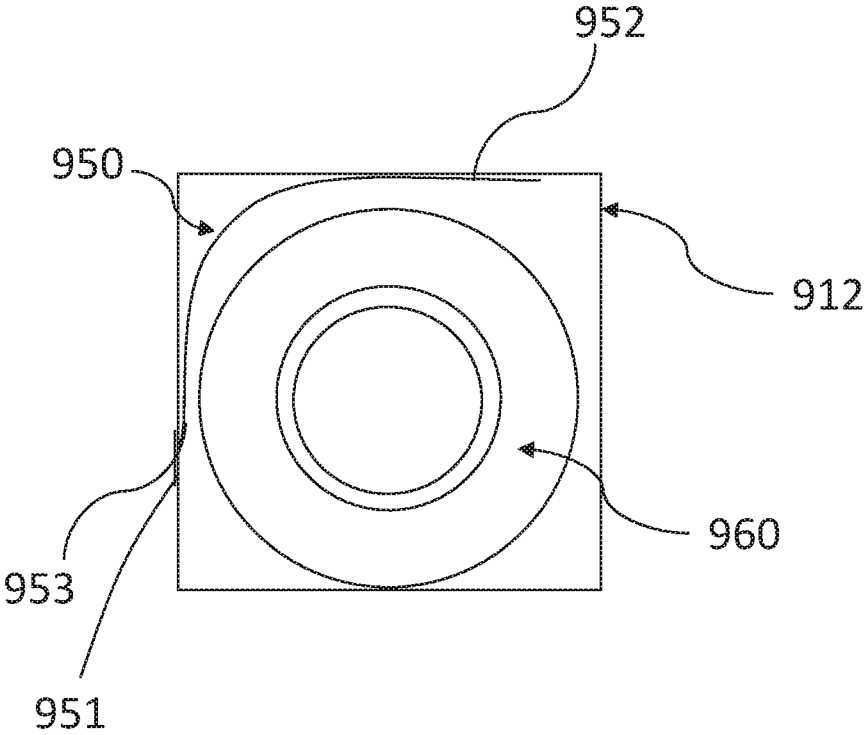
FIG. 9*j* is a cross-sectional view taken at C-C of FIG. 9*i;*

FIG. 9*i* illustrates Step 6 of the method of manufacture, showing a front view wherein the end walls of the dispensing box are closed and the dispensing box readied for shipment. FIG. 9*j* is a cross-sectional view taken at C-C of FIG. 9*i*. At Step 6, the end walls of the dispensing box are closed and the dispensing box readied for shipment. The roll tensioner is adapted to rest in the first position until the roll tensioner is engaged to move into the second position during use. When in the second position the roll tensioner's distal end section is adapted to rest against the wrapping material proximal to the wrapping material cut edge to retain the wrapping material cut edge in an upward, substantially parallel position to the interior front wall of the wrapping material box for easy grasping of the wrapping material cut edge. It is noted that these steps are presented in a preferred order, but the order may be re-arranged to suit manufacturing systems and methods without departing from the scope of the invention.

Figure 10A:
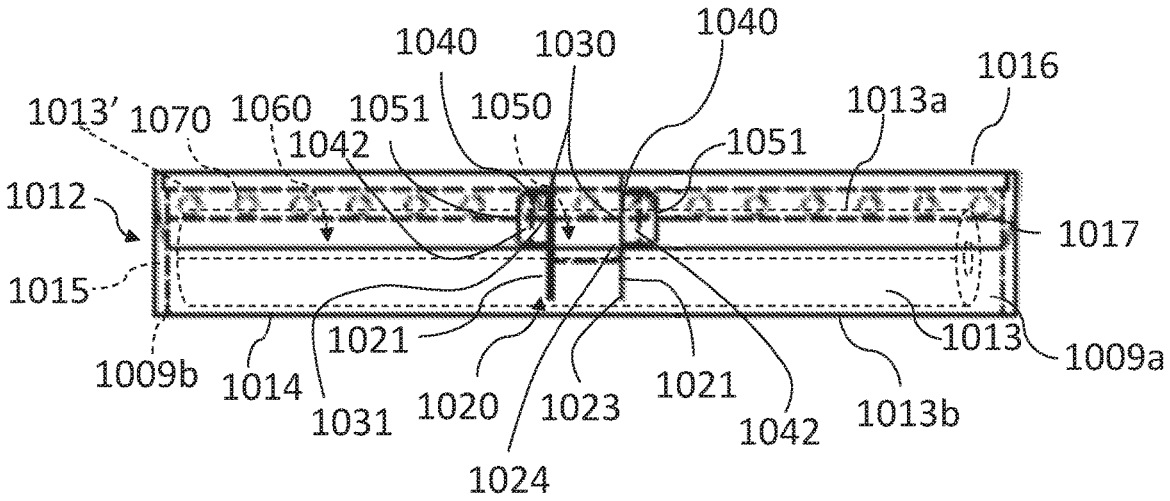
FIG. 10*a* is a front view of an embodiment of the tensioner system illustrating operation and use of the roll tensioner system, showing the closed box with the roll tensioner upward in its first position maintained from the manufacturing and shipping process.
Figure 10B:
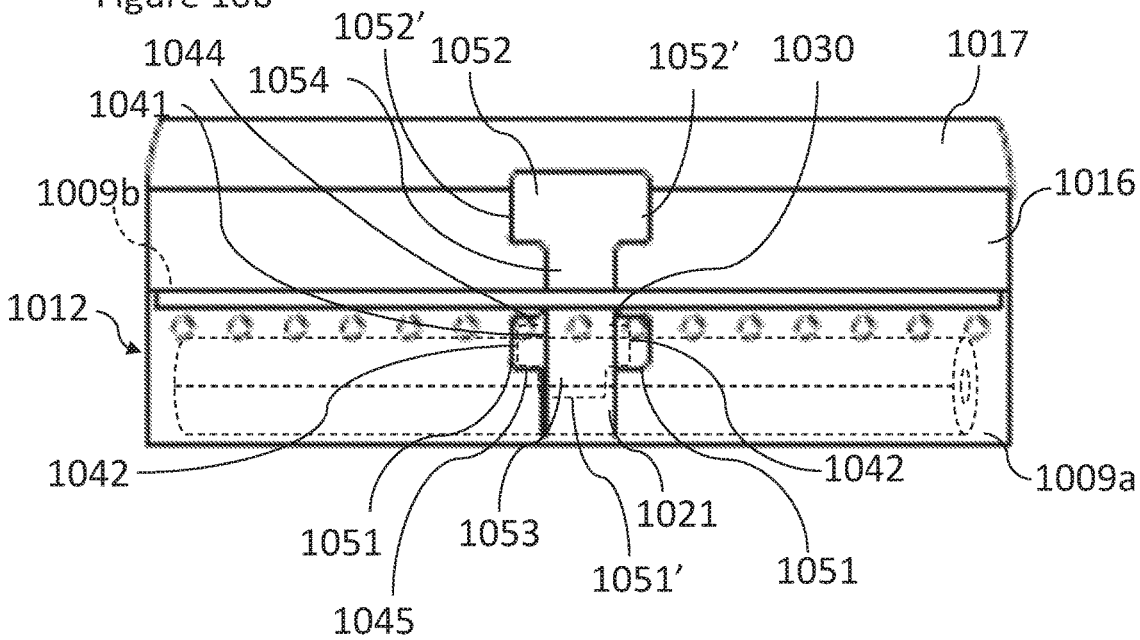
FIG. 10*b* is a front view of the roll tensioner system showing an open box lid and the spring of the roll tensioner upward, with the roll tensioner in the first position.
Figure 10C:
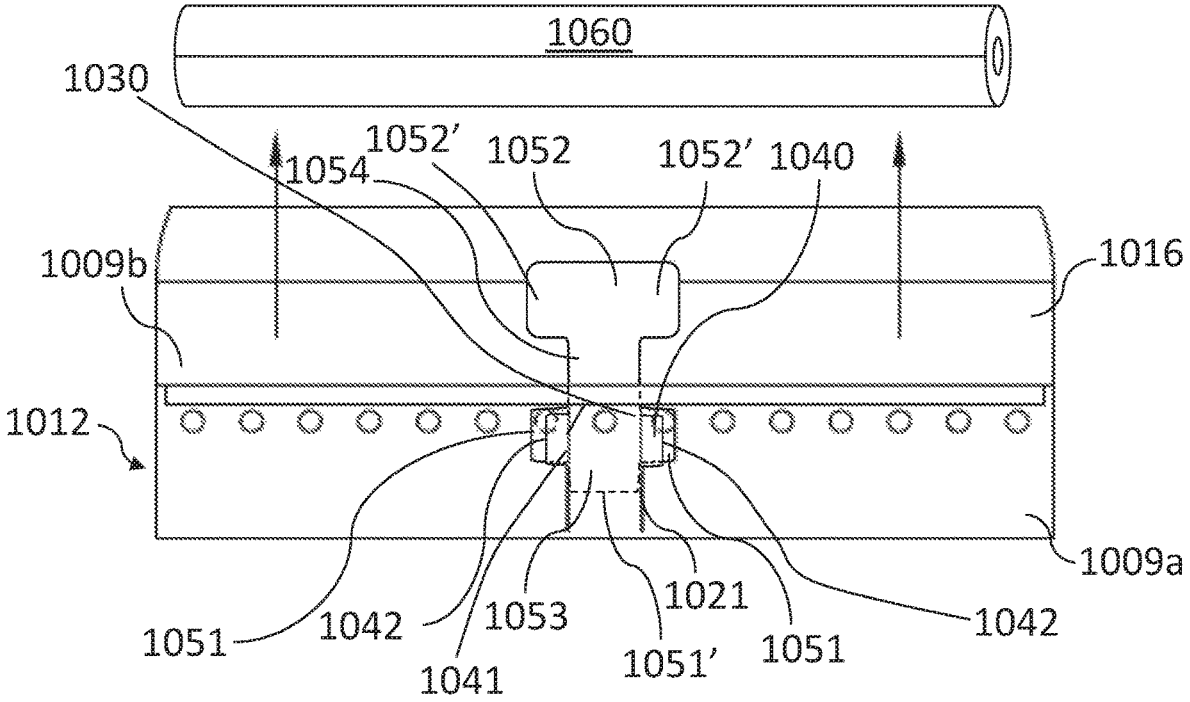
FIG. 10*c* is a front view of the roll tensioner system showing operation and use of the roll tensioner system, showing optional removal of the material roll for access to the interior of the box and the roll tensioner.
Figure 10D:
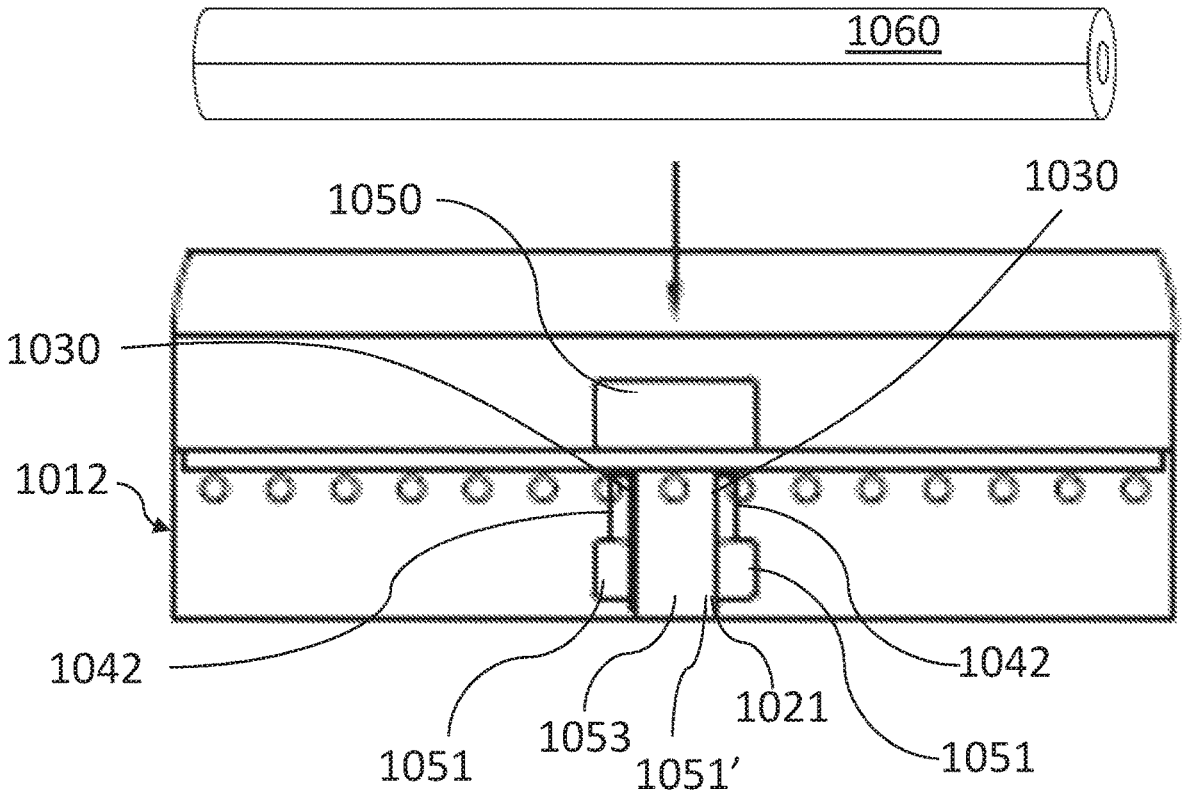
FIG. 10*d* is a front view of the roll tensioner system showing manual movement of the roll tensioner slid downward, into a second position, and the activation of the locking flaps.
Figure 10E:
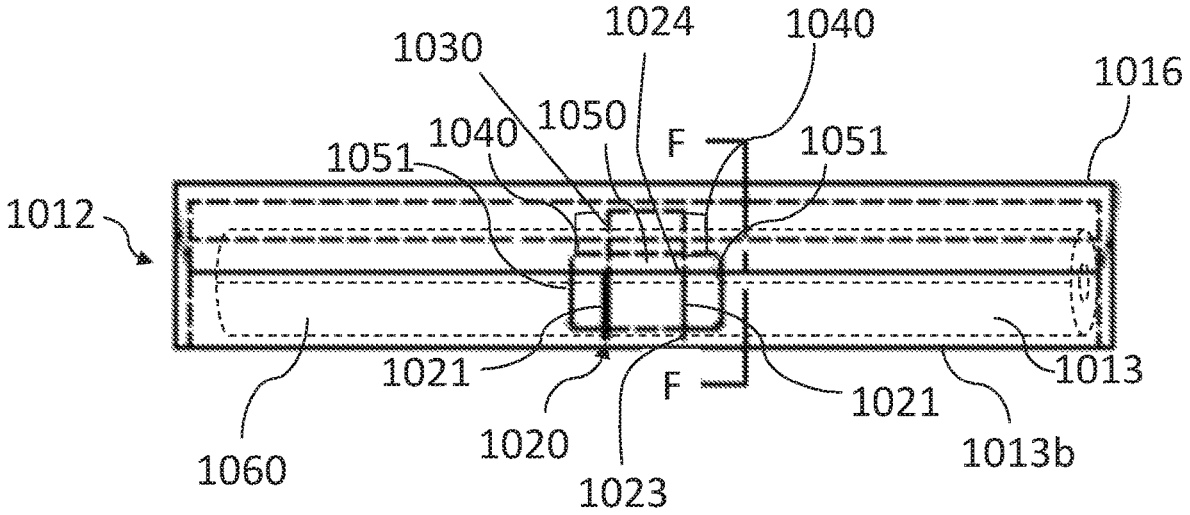
FIG. 10*e* is a front view in operation and use, showing the box in the closed condition and the tensioner in the second position, bent towards and abutting material roll, ready for use.
Figure 10F:
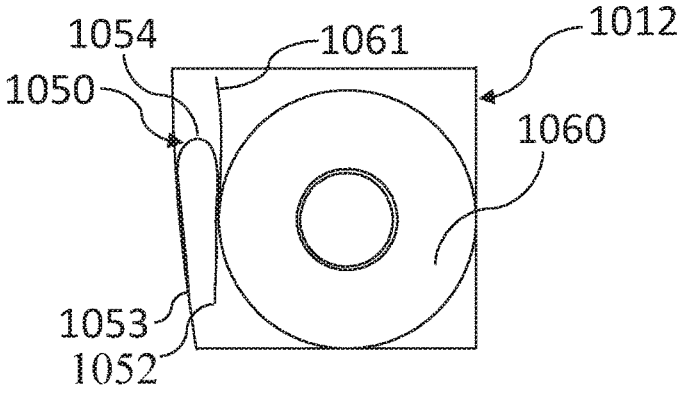
FIG. 10*f* shows cross sectional view taken along F-F in FIG. 10*e;*

FIGS. 10*a*-10*g* illustrate a method of using the wrapping material roll tensioner system of FIGS. 9*a*-9*l*. FIG. 10*a* is a front view of an embodiment of the tensioner system illustrating operation and use of the roll tensioner system, showing the closed box with the roll tensioner upward in its first position maintained from the manufacturing and shipping process. FIG. 10*b* is a front view of the roll tensioner system showing an open box lid and the distal end of the roll tensioner upward, with the roll tensioner in the first position. FIG. 10*c* is a front view of the roll tensioner system showing operation and use of the roll tensioner system, showing optional removal of the material roll for access to the interior of the box and the roll tensioner. FIG. 10*d* is a front view of the roll tensioner system showing manual movement of the roll tensioner slid downward, into a second position, and the activation of the locking flaps. FIG. 10*e* is a front view in operation and use, showing the box in the closed condition and the tensioner in the second position, bent towards and abutting material roll, ready for use. FIG. 10*f* shows cross sectional view taken along F-F in FIG. 10*e*.

Referring to FIGS. 10*a*-10*f*, box 1012 has an exterior face 1009*a* and an interior face 1009*b* forming the interior of the box 1012 with wrapping material/foil 1060 housed therein. Box 1012 is constructed generally having a front wall 1013 with a serrated cutter strip 1013' adapted to cut the rolled wrapping material/foil/material roll 1060 as it is being used. Front wall 1013 abuts a bottom wall 1014, which in turn abuts back wall 1015, which in turn abuts top wall 1016 abutting top flap 1017 sealed against front wall 1013 by way of glue 1070.

A tensioner slide assembly 1020 is integrated in front wall 1013 having two opposing parallel slits 1021 extending on the front wall 1013 of the dispensing box 1012. Parallel slits 1021 are preferably formed as narrow cuts having one or more kiss cuts, cut-scores, nicks or connection points (see for example, FIG. 9*b*, at 922) adapted to breakaway when force, such as pressing by a user, is applied. Parallel slits 1021 comprise a bottom end point 1023 located a distance "s" perpendicular from a bottom edge 1013*b* of front wall 1013. Preferably, the distance "s" is at least ¼" (6.35 mm) from said bottom edge 1013*b* of said front wall 1013. Parallel slits 1021 extend from said bottom end point 1023 to a top end point 1024 (see also, FIG. 9*b* at 924) adjoining two opposing parallel slots 1030. Two opposing parallel slots 1030 extending through the front wall of the dispensing box adjoin parallel slits 1021 on front wall of the dispensing box. Parallel slots 1030 share a primary assembly side wall 1031 with the parallel slits 1021. Two opposing parallel locking flaps 1040 are integrated within the parallel slots 1030, sharing a secondary assembly wall side 1041 with the parallel slots 1030. Locking flaps 1040 are appointed to be deployed at a later time, such as when the consumer opens and uses the final wrapping material with tensioner system product. Locking flaps 1040 are formed as parallel tabs abutting and flush with parallel slots 1030 are appointed to fold at fold lines 1042 when the system is in use. The locking flaps 1040 have a flap height and the parallel slots 1030 have a slot height, wherein the flap height is preferably less than the slot height.

The locking flaps 1040 have a flap top wall 1044 and flap bottom wall 1045 that terminate at fold line 1042. Flap top wall 1044 and flap bottom wall 1045 are adapted to break-away when a pressing force is applied later by an end user/user. Preferably, flap top and bottom walls, 1044, 1045, are formed as narrow cuts having one or more kiss cuts, cut-scores, nicks or connection points adapted to breakaway when force, such as pressing by an end-user, is applied. When the locking flaps 1040 are pushed outward, separating to break-away from the inside of the front wall 1013 and pressed outward to bend at the bend wall/fold line 1042 bending is facilitated without tearing. Locking flaps 1040 are in the stored position prior to use and adapted to open to a locking position by an end-user (as shown, for example in FIG. 10*d*). The flap top and flap bottom walls 1044, 1045, break-away when pressing force is applied, and the locking flaps 1040 are then appointed to be bent outward along the fold line 1042 by an end-user.

As discussed hereinabove, tensioner 1050 is mounted within a tensioner slide assembly 1020 by way of opposing bottom tabs 1051 inserted within parallel slots 1030 with locking flaps 1040 flat or disengaged. Roll tensioner 1050, in the embodiment shown, is constructed having opposing bottom tabs 1051 that flex and bend when inserted through parallel slots 1030 of box 1012 during manufacturing to secure the tensioner 1050 within the box 1012. Roll tensioner 1050 has a distal end section 1052 and a proximal end section 1053, separated by a spring back/reversion section 1054. Proximal end section 1053 includes opposing bottom tabs 1051 and, preferably, a center bottom tab 1051' (for stability) adapted to secure the tensioner 1050 in place within the wrapping material box 1012.

In a first position, distal end 1052 bends upward and over the material roll 1060 resting against the top wall 1016 of the box 1012. In use, as discussed hereinafter, the tensioner 1050 is appointed to be moved to slide from the first position in the parallel slots 1030 downward into parallel slits 1021 to a second position and the locking flaps 1040 are pushed outward to prevent movement of the roll tensioner 1050. In this position, the second position, the roll tensioner 1050 is engaged, with the distal end 1052 extending downward via spring back/reversion section 1054 in the interior of box 1012 when a force is applied (i.e. the wrapping material roll). Preferably the distal end 1052 includes opposing top tabs 1052' forming a "T" distal end section thereby providing greater surface area for abutting wrapping material on a material roll so that the wrapping material end is pushed upward for easy grasping by an end user.

FIG. 10*b* illustrates an open top wall 1016 with open closure flap 1017. Upon opening, the roll tensioner 1050, still in its first position in the tensioner slide assembly 1020, springs upward. FIG. 10*c* illustrates careful removal of the material roll 1060 from the box 1012. The roll tensioner 1050 remains sprung in the upright position/first position.

FIG. 10*d* illustrates manual movement of the roll tensioner 1050 into the second position and activation of the locking flaps 1040. While holding the box 1012 with one hand, the user grasps the roll tensioner 1050 with the other hand and carefully slides it evenly down the parallel slots 1030 into the parallel slits 1021 until the bottom of the roll tensioner 1050 touches the bottom end point 1023 of parallel slits 1021 proximal to bottom wall 1014 of the box 1012. The user then locates the locking flaps and gently pushing from the inside out, breaking any nicks/connection points that may be located on the top and bottom wall, 1044, 1045, of locking flaps 1040, and bends the locking flaps 1040 outward along bend line 1042 so they open or engage outward to lock the roll tensioner 1050 in place. Nicks/connection points may be included in the top and bottom wall 1044, 1045 for breakaway from the front wall during this operation. Alternatively, the top and bottom wall 1044, 1045, do not include nicks/connection points.

As shown in FIG. 10*d*, the roll tensioner 1050 is located in the second position and the material roll 1060 is lowered back into box 1012. With one hand the user gently bends the roll tensioner 1050 into the box 1012 while lowering the roll 1060 back into the box 1012, with the material cut end unrolling up from the bottom between the roll tensioner 1050 and the material roll 1060, keeping the roll tensioner 1050 against the roll 1060 for best performance. With some larger diameter material rolls, to prevent a "pop up", a light squeeze at the bottom may be necessary until the material roll 1060 reduces in diameter. Roll diameters can vary within the same box size. A heavy squeeze near the center or top in this condition may cause a crease. However, this will not affect the performance.

As illustrated by FIG. 10*e*, the roll 1060 is resting back in the box 1012 and the system is ready for use by the consumer. FIG. 10*f* shows a cross-sectional view taken along F-F in FIG. 10*e*. Roll tensioner 1050 is shown in its use position with the distal end abutting the end of the material/foil on roll 1060, retaining the end 1061 in an upright ready for use and easily grab position. The tensioner 1050 is thus preloaded against the roll 1060, whereby the lid can be securely closed without interference from tensioner 1050.

Instead of removal of the material roll 1060, alternatively the material roll 1060 may remain in the box 1012 and the roll tensioner 1050 slid downward into the second position and fold the locking flaps outward to lock tensioner in position. The front wall of the box 1012 can be bent outward to create a space to bend the distal end of the tensioner 1050 so it can rest against the material roll.

Figure 11A:
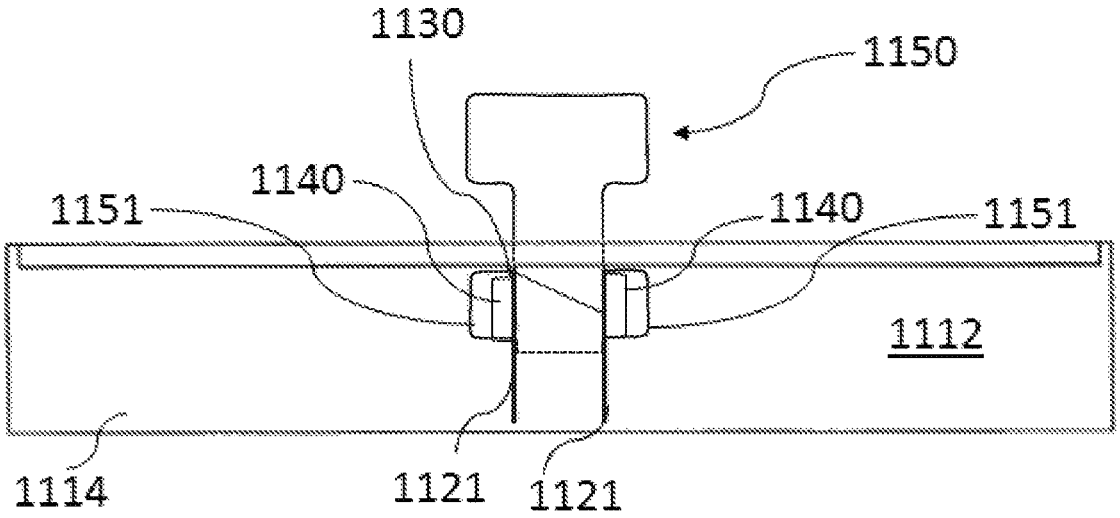
FIG. 11*a* shows a front view of the first position of the roll tensioner in relation to the box when the system is being set-up for use.
Figure 11B:
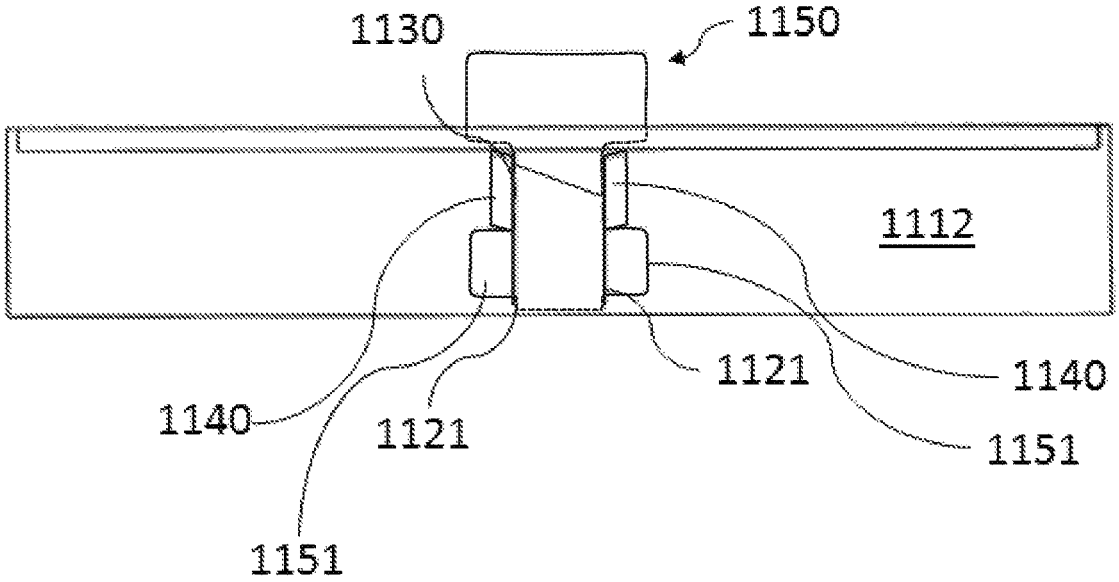
FIG. 11*b* shows a front view of the second position of the roll tensioner in relation to the box when the roll tensioner is in the second position and the locking flaps are engaged.

FIGS. 11*a*-11*b* illustrate a frontal view of the wrapping material box system with the lid removed, showing the positions of the roll tensioner 1150. FIG. 11*a* illustrates a first position of the roll tensioner 1150 with opposing bottom tabs 1151 inserted in parallel slots 1130 in relation to the box 1112. Tensioner 1150 is adapted to be slid down slots 1130 into parallel slits 1121 into a second position. Once in this second position, locking flaps/flaps 1140 are opened outward from the interior of the box 1112 and engaged. FIG. 11*b* illustrates the second position of the roll tensioner 1130 and engagement of the locking flaps/flaps 1140 in relation to the box 1112 when engaged for use.

Figure 12A:
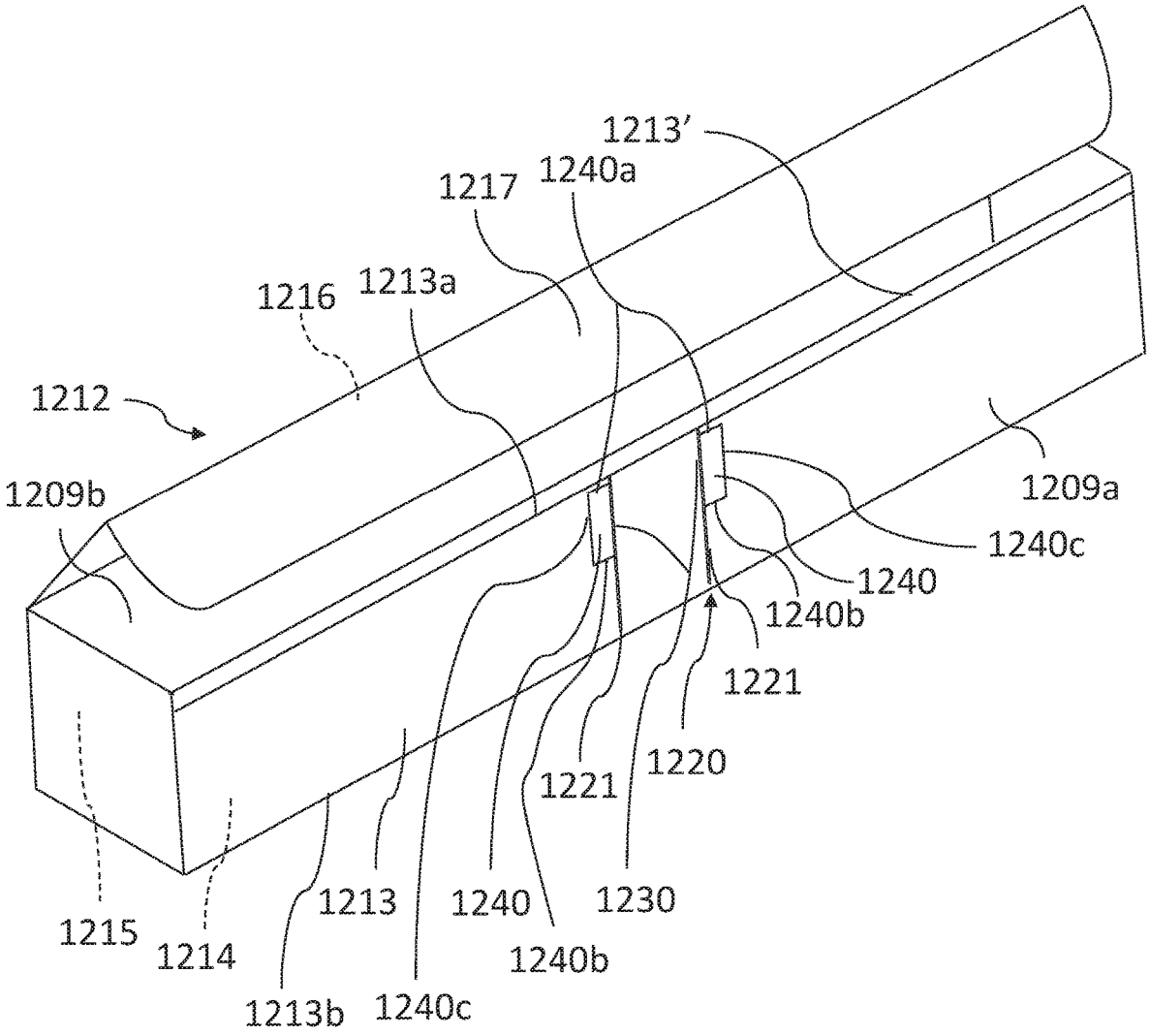
FIG. 12*a* shows an isometric view of an opened box adapted to receive and house a wrapping material/foil roll and the subject roll tensioner, wherein the roll tensioner is in a first position and the locking flaps are not open or engaged.
Figure 12B:
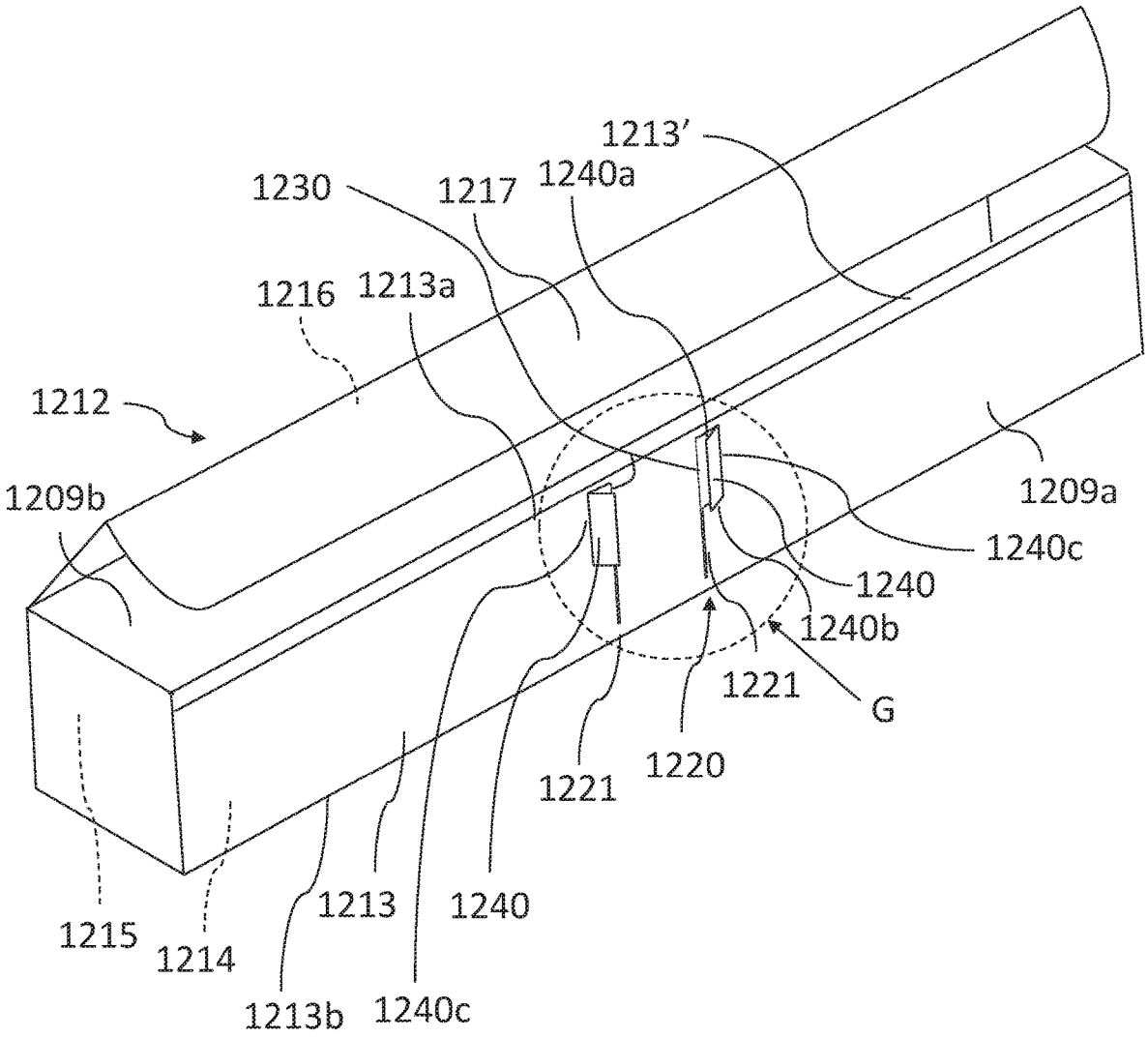
FIG. 12*b* shows an isometric view wherein the locking flaps are in a second position, hingedly opened and engaged for locking the roll tensioner in place.
Figure 12C:
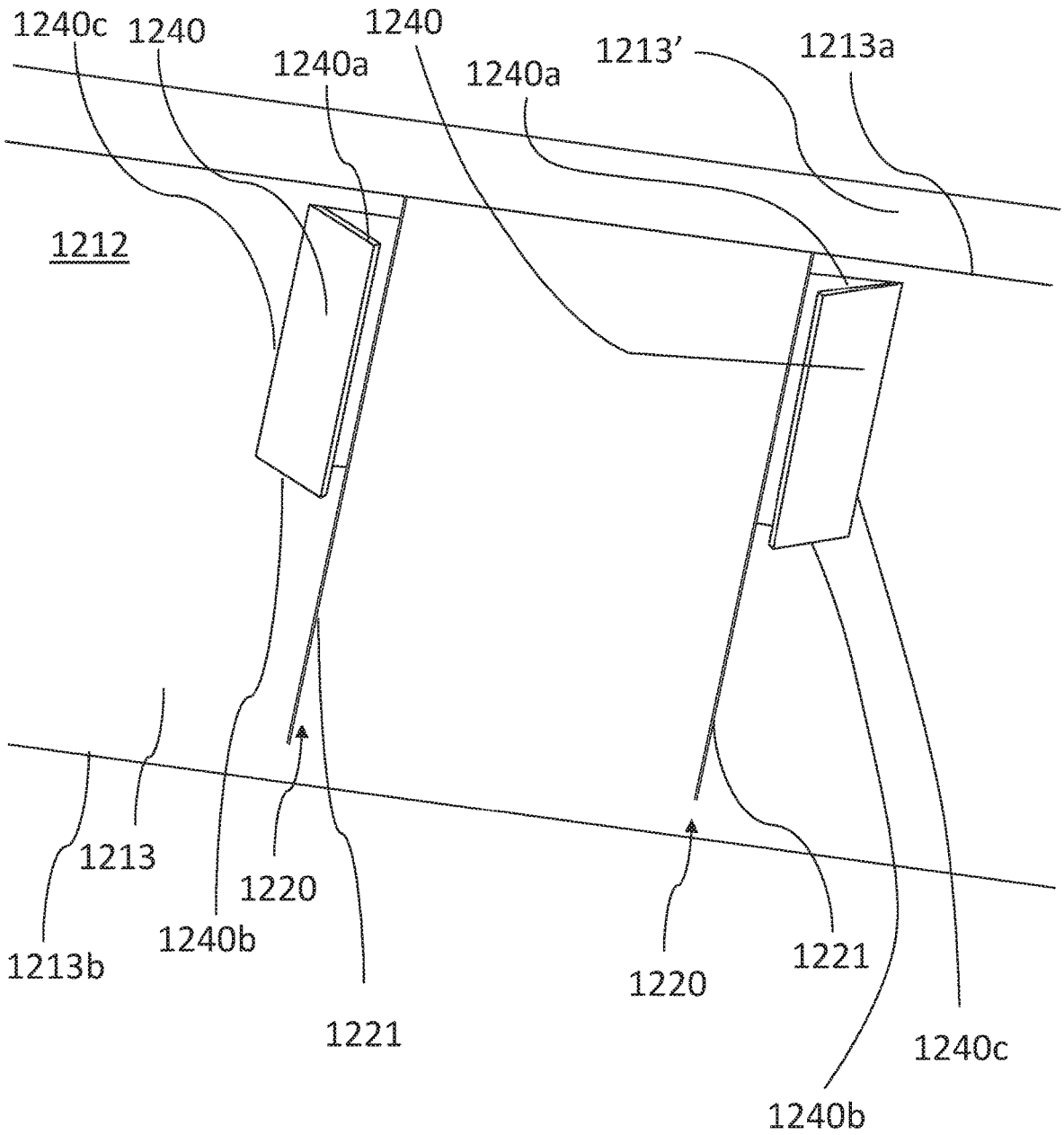
FIG. 12*c* is an enlarged view taken at G of FIG. 12*b;*

FIGS. 12*a*-12*c* show views of the box with a tensioner slide assembly of the subject system and method. FIG. 12*a* shows an isometric view of an opened box 1212 adapted to receive and house a wrapping material/foil roll and the subject roll tensioner, wherein the locking flaps 1240 are closed and disengaged. FIG. 12*b* shows an isometric view wherein the locking flaps 1240 are hingedly opened and engaged for locking a roll tensioner in place for use. FIG. 12*c* is an enlarged view at G of FIG. 12*b*. As discussed hereinabove, a roll tensioner is adapted to be mounted within the tensioner slide assembly 1220 by way of opposing bottom tabs of the roll tensioner inserted within parallel slots 1230 with locking flaps 1240 flat or disengaged during manufacture of the box 1212. The roll tensioner is appointed to slide downward into parallel slits 1221 as discussed hereinabove, to the second position and the locking flaps 1240 engaged when it is time for use by the end-user. It is noted that alternatively box 1212 may be formed with the slot assembly 1220 and the roll tensioner can be separately added into the slots 1230 by the end-user or by a user.

Box 1212 has an exterior 1209*a* and an interior 1209*b*. Box 1212 is constructed generally having a front wall 1213 with a serrated cutter strip 1213' adapted to cut the rolled material as it is being used. Front wall 1213 abuts a bottom wall 1214, which in turn abuts back wall 1215, which in turn abuts top wall 1216 abutting top flap 1217 adapted to be sealed against front wall 1213 by way of glue.

Tensioner slide assembly 1220 is integrated in front wall 1213, formed as parallel slots 1230 terminating or adjoining narrow slits 1221 or preferably having score-lines or kiss cuts, etc, and parallel to integrated locking flaps 1240. Slots 1230 are formed as two parallel lines or a narrow gap or opening extending on front wall 1213. Locking flaps 1240 are integrated along a portion of parallel slots 1230. Locking flaps 1240 have flap top wall 1240*a* and flap bottom wall 1240*b* that are preferably breakaway via kiss cuts or score-lines, etc, to be broken and deployed when the consumer opens and uses the final wrapping material with tensioner system product. Locking flaps 1240 are formed as parallel tabs abutting and flush with slots 1230 and are appointed to fold at fold line 1240*c* when the system is in use. Locking flaps 1240 share a side wall with parallel slot 1230.

Figure 13A:
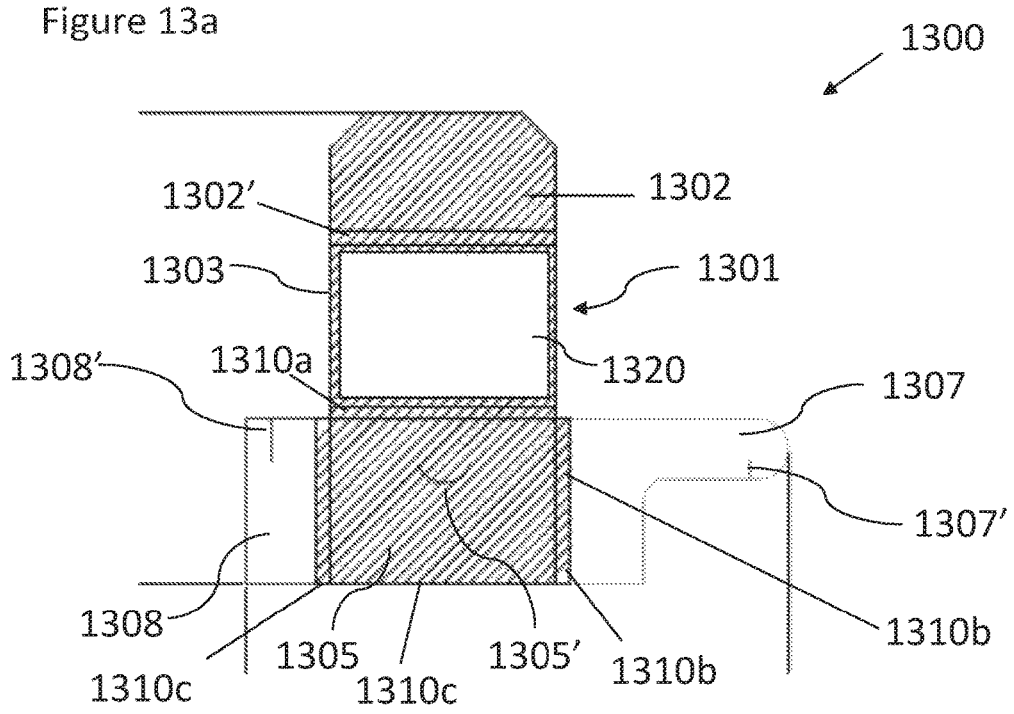
FIG. 13*a* shows an outside, top plan view of an embodiment of a roll tensioner dispenser, shown in an unfolded condition.
Figure 13B:
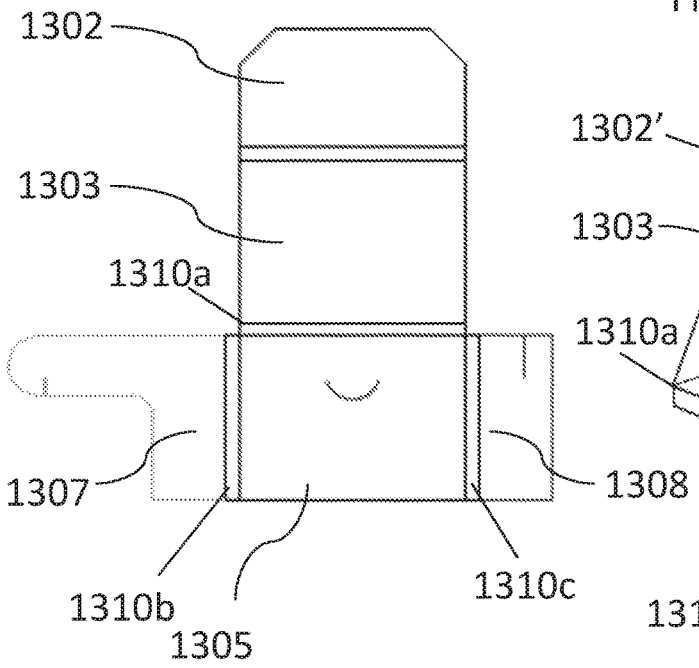
FIG. 13*b* shows an inside, top plan view of the unfolded dispenser of FIG. 13*a;*
Figure 13C:
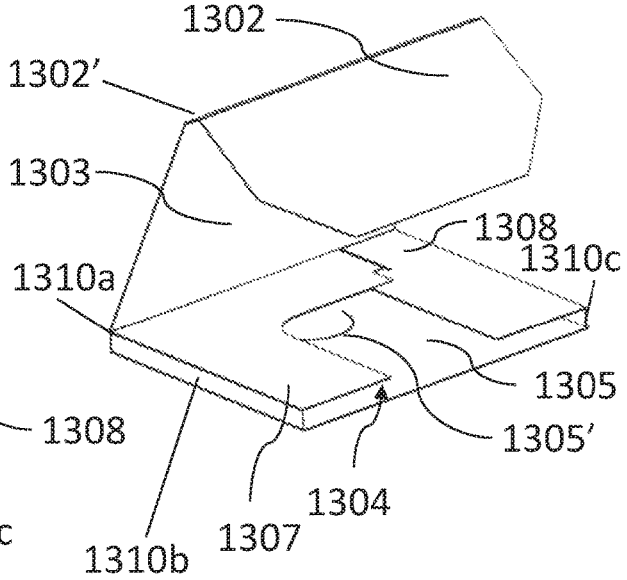
FIG. 13*c* shows an isometric exterior view of the dispenser of FIG. 13*a;*

FIGS. 13*a*-13*c* illustrate an embodiment of a roll tensioner dispenser. FIG. 13*a* shows an outside, top plan view of an unfolded dispenser, shown generally at 1300. FIG. 13*b* shows an inside, top plan view of the unfolded dispenser of FIG. 13*a*. FIG. 13*c* shows an isometric exterior view of the dispenser of FIG. 13*a*. The dispenser 1301 can readily be setup on a refrigerator door, for a dedicated function as a dispenser of the roll tensioners.

Referring to FIGS. 13*a*-13*c*, dispenser 1301 is adapted to receive a plurality of roll tensioners therein. Dispenser 1301 includes a top flap 1302 bendably attached by way of a narrow top flap wall 1302' to a central flap 1303 bendably attached to a bottom flap 1305 by way of a central narrow side wall 1310*a*. Central flap 1303 preferably includes a magnet 1320 adapted to attach the dispenser 1301 to a refrigerator, appliance, or otherwise steel surface. In addition to the central narrow side wall 1310*a*, bottom flap 1305 includes laterally located bendably attached narrow side walls 1310*b*, 1310*c* attached to first and second side walls, 1307 and 1308, respectively. A pocket 1304 is formed by way of bending narrow side wall 1310*b* and first side wall 1307, side wall 1310*c* and second side wall 1308, central narrow side wall 1310*a* and central flap 1303, and narrow top flap wall 1302' and top flap 1302 (see FIG. 13*c*). First side wall 1307 includes a slit notch 1307' and second side wall 1308 includes a mating slit notch 1308' for locking first and second side walls, 1307, 1308, together over bottom flap 1305 to secure formed pocket 1304. Bottom flap 1305 has a slit 1305' therein for receiving top flap 1302 when the dispenser is closed. These dispensed roll tensioners may be sold as aftermarket add-ons to any standard existing material roll dispensing box, a box with a roll tensioner assembly system, or even as replacement roll tensioners for any tensioner embodiment with or without adhesive. The dispenser 1301 can readily be setup on a refrigerator door, for a dedicated function as a dispenser of the roll tensioners.

Other dispenser structures are contemplated, and may include magnets, etc., for magnetic attachment to a steel surface, such as the side of a refrigerator. Dispensers may come in custom made shapes, including parallelogram, cylindrical and rectangular tube-like structures, which would also provide a means of dispensing the roll tensioners.

Figure 14A:
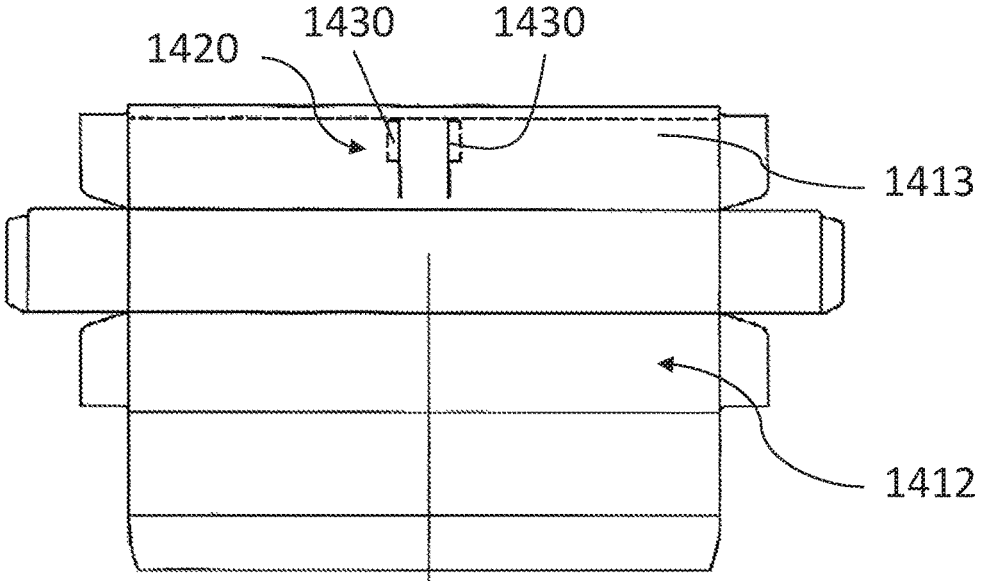
FIG. 14*a* illustrates a top plan inside view of a flat or open box with a tensioner slide assembly die-cut or stamped into a front wall of box.
Figure 14B:
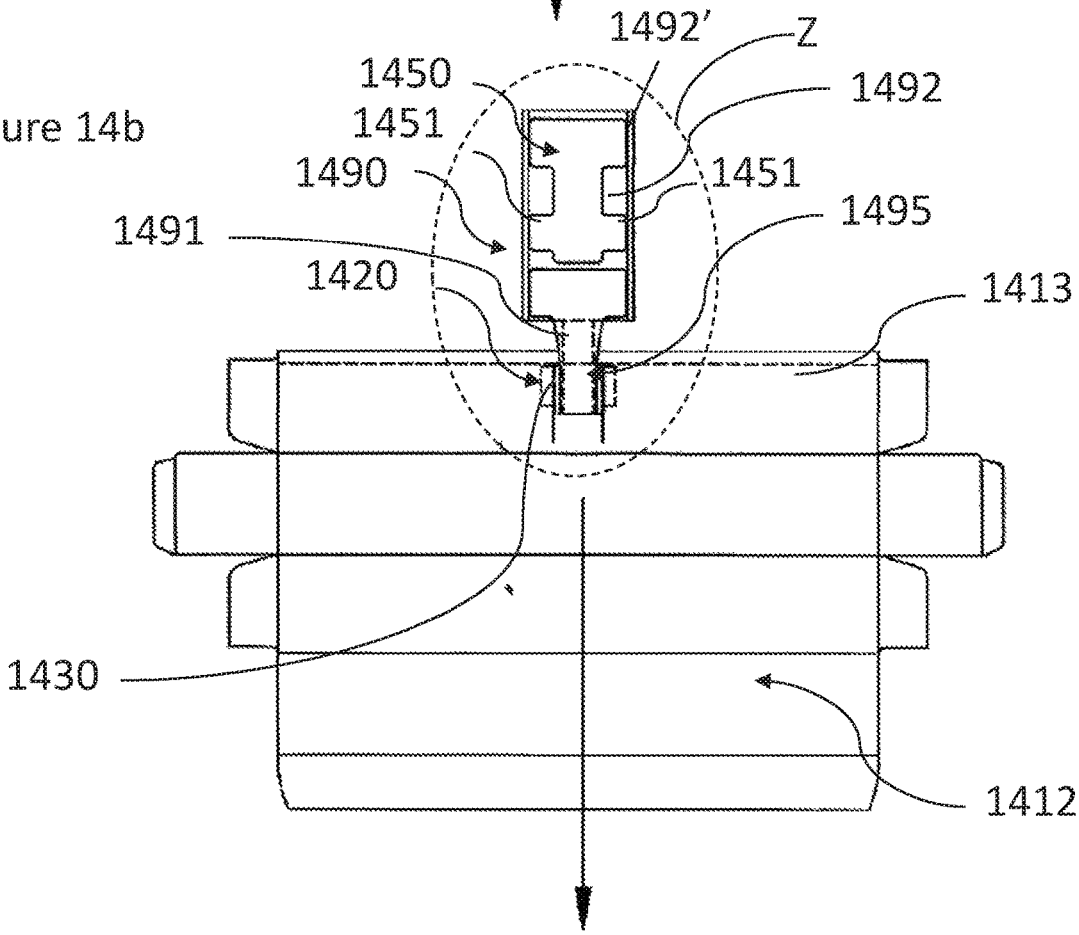
FIG. 14*b* illustrates a top plan inside view of the box of FIG. 14*a* with a mandrel and saddle utilized for inserting opposing bottom tabs of the roll tensioner into parallel slots of the tensioner slide assembly.
Figure 14C:
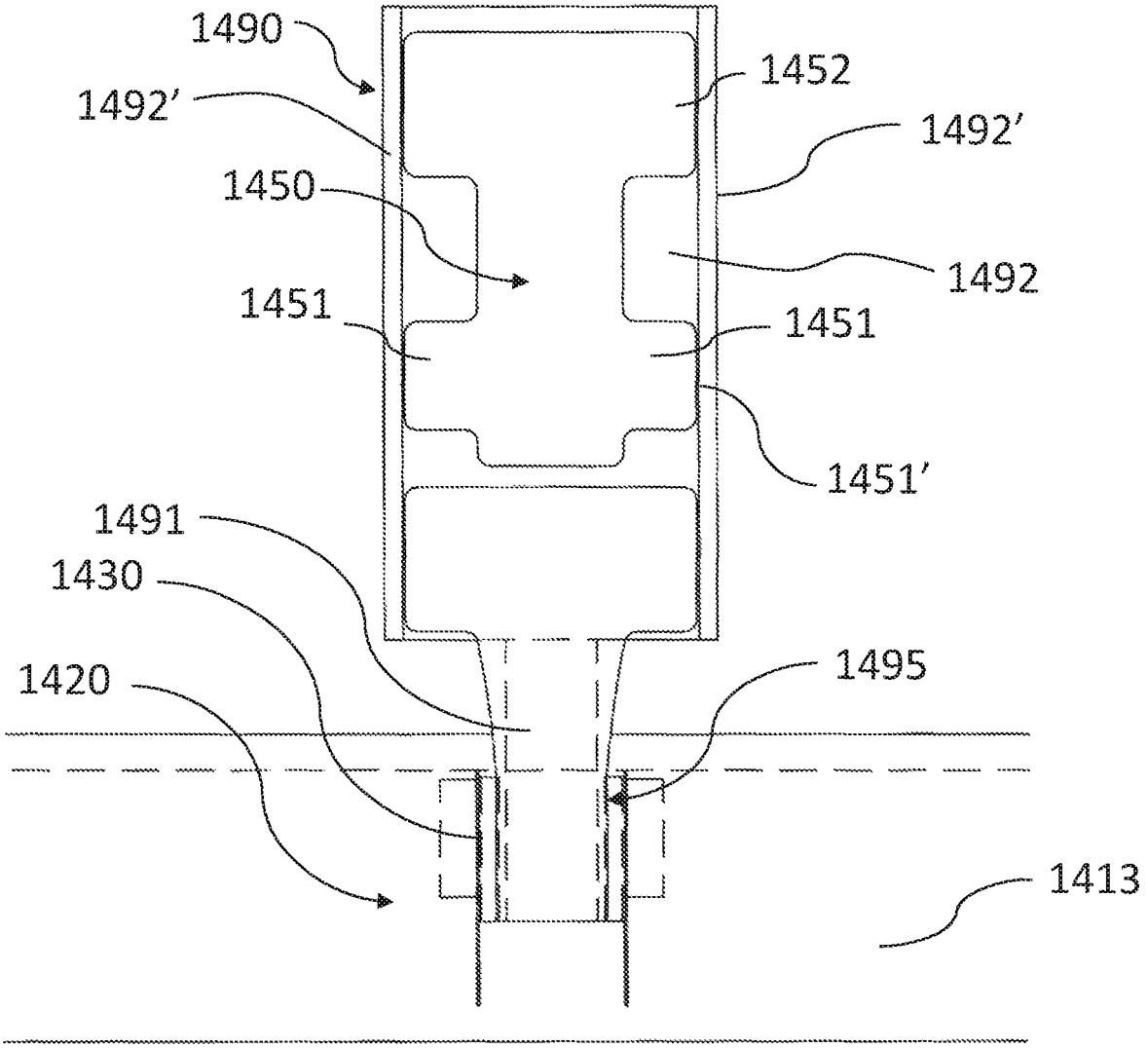
FIG. 14*c* illustrates an enlarged view taken at Z in FIG. 14*b;*
Figure 14D:
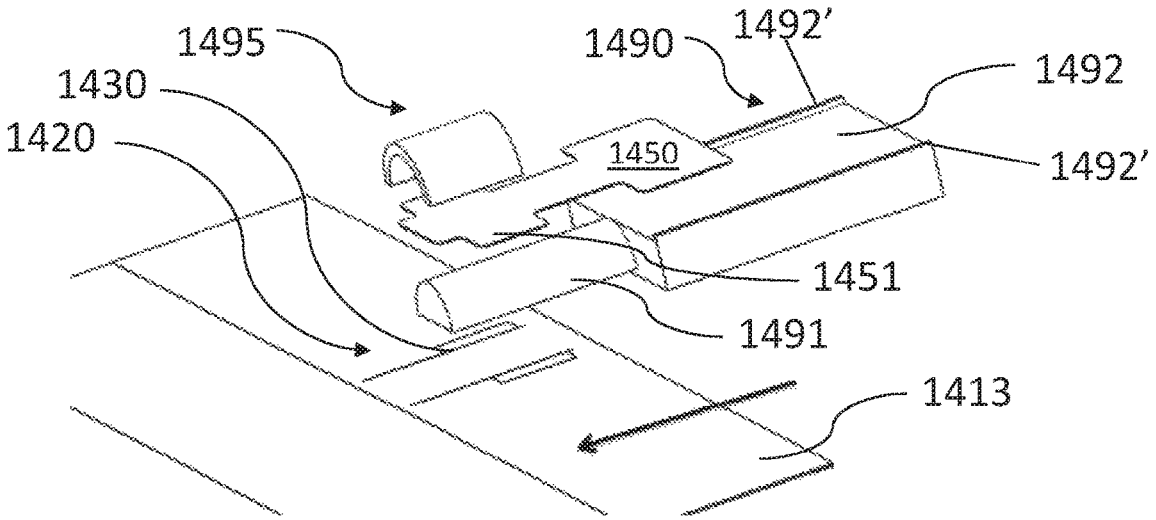
FIG. 14*d* illustrates an exploded isometric view taken at Z in FIG. 14*b;*
Figure 14E:
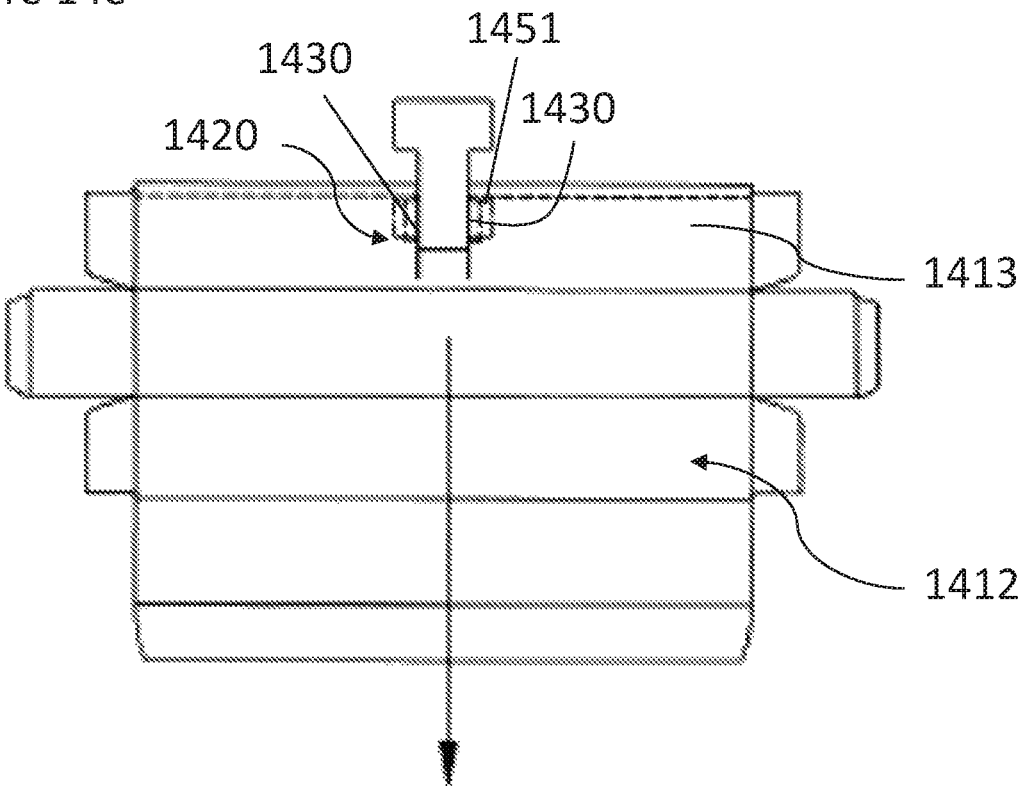
FIG. 14*e* illustrates a top plan view of the box of FIG. 14*a* with the roll tensioner inserted into parallel slots of the tensioner slide assembly.

FIGS. 14*a*-14*e* illustrate views of an embodiment of a mandrel and saddle configuration appointed to be utilized during the manufacturing process for insertion of a roll tensioner's opposing bottom tabs into opposing parallel slots of the tensioner slide assembly as discussed in detail herein. FIG. 14*a* illustrates a top plan inside view of a flat or open box 1412 with a tensioner slide assembly 1420 die-cut or stamped into a front wall 1413 of box 1412. FIG. 14*b* illustrates a top plan inside view of the box 1412 of FIG. 14*a* with a mandrel 1490 and saddle 1495 utilized for inserting opposing bottom tabs 1451 of the roll tensioner 1450 into parallel slots 1430 of tensioner slide assembly 1420. FIG. 14*c* illustrates an enlarged view taken at Z in FIG. 14*b*. FIG. 14*d* illustrates an exploded isometric view taken at Z in FIG. 14*b*. FIG. 14*e* illustrates a top plan view of the box of FIG. 14*a* with the roll tensioner inserted into parallel slots of the tensioner slide assembly.

Generally, for use in box assembly on an automated production line, the mandrel and saddle or saddle clamp principle of assembly mechanism is appointed for use during insertion of tensioner opposing bottom tabs into the parallel slots on the front of the roll dispenser box. The saddle or saddle clamp variable travel distance from the mandrel allows for adjustment between opposing bottom tabs to match the slot spacing in the roll dispensing box. Mandrel 1490 is constructed having a tensioner square or substantially flat mandrel bed 1492 with guide rails 1492' and a cylindrical or half-round/less than half-round partial cylinder shape 1491 in the front or proximal portion of the mandrel assembly to allow a short tapered/arched adjustable forming clamp or saddle 1495 to circumferentially engage over the opposing bottom side tabs 1451 of the tensioner 1450. This causes the opposing side tabs 1451 to bend towards the roll dispenser box with their ends at the same distance from each other, as the spacing of the opposing parallel slots 1430 on the front wall 1413 of the roll dispenser box 1412. The edges of the proximal opposing side tabs, shown generally at 1451', also need to be on a plane parallel to the parallel slots 1430 of the roll dispensing box 1412. In order to control the potential slippage of the tensioner while the proximal end opposing bottom side tabs are being bent towards the roll dispenser box via the arched clamp or saddle 1495, the rear or distal portion of the mandrel assembly preferably has a substantially flat mandrel bed 1492 or other means for holding the distal end 1452 of the tensioner 1450 flat and square to the centerline of the mandrel assembly and remains guided in the process.

In the next step, the complete mandrel 1490 and clamp/saddle 1495 assembly holding the portion of the bent tensioner 1450 is either moved towards the front parallel slots 1430 on the front of the roll dispenser box, or the table with the box is moved towards the mandrel 1490 and clamp/saddle 1495 assembly so the opposing bottom side tabs 1451 of the tensioner 1450 engage into the slots/parallel slots 1430 of the tensioner slide assembly on the front wall of the box. At this time, in one embodiment, the mandrel assembly only, releases the tensioner and slides away from the mandrel 1490 and clamp/saddle 1495, allowing the tensioner to snap into the assembled first position on the roll dispenser box due to the natural properties of the tensioner material which will cause it to want to return to its original flat shape. On the final step, the arched clamp/saddle 1495 is moved away from the box, the box/tensioner assembly is moved down the assembly line for folding and gluing the roll dispenser box lid's closure flap to the front wall of the box, and both a new box and the next tensioner can be brought to follow the same prior sequence.

In a different embodiment, the mandrel 1490 and clamp/saddle 1495 assembly is stationary, the tensioner is fed into the guided loading position as in the prior art, via drive rollers, guides or other means; the tensioner is firmly held in place over the distal end and held flat, the saddle or saddle clamp is moved over the mandrel proximal end, adjustable via a pneumatic cylinder, a solenoid coil or other means, bending the opposing bottom side tabs, causing the edges to be parallel and on the same plane as the slots of the roll dispensing box for equal engagement. The box in the flat position is fed and guided via drive rollers or other means, to the opposing bottom tabs 1451 of the tensioner. Slots 1430 rest directly aligned to the bent proximal opposing side tabs 1451 of the tensioner. The guided mechanism holding the box is moved so the proximal opposing bottom side tabs engage into the slit slots of the box; at this time, the clamp/saddle 1495 is retracted away from the tensioner and the tensioner/box assembly together is pulled away from the mandrel 1490. The next tensioner and box can now be fed for another sequential assembly. With either previous embodiments, the guided mechanism handling the roll dispenser box, preferably has a relief and taper forward, in the direction of travel of the box, behind the box slit slots at the point of engagement of the tensioner, so the proximal opposing side tabs are clear to travel unobstructed in an arch motion from the bent engaging position to near flat as the box and tensioner assembly are pulled away from the mandrel.

Once the tensioner is held flat on the mandrel assembly, via a clamp, drive roller mechanism or similar purpose device, the inside front wall of the dispenser box with the already installed serrated cutting edge (facing away from the mandrel assembly), in the flat unassembled configuration with the custom formed slit slot assembly, is positioned and held with the slit slots directly in line with the bent ends of the opposing and parallel bottom side tabs of the tensioner, with the serrated cutting edge opposite the rear portion of the mandrel which holds the spring back/reversion section of the roll tensioner.

The roll dispenser box as depicted in FIGS. 12*a* and 12*b*, manufactured with the custom designed slit slots and locking flaps, can be universally sold as presented at the manufacturer's option of either installing the roll tensioner via an automated process or simply including the roll tensioner inside the box for the end user to install. As such, another embodiment of the box design is to die cut, stamp or form shorter parallel slits or kiss cuts with nicks dedicated to the final operational position of the roll tensioner, and supply the later attached to the box inside top wall or lid via fugitive glue or other method as described below; this way, the roll tensioner can be attached to the box during the box assembly and be clear from the roll path at the roll insertion station, the end user would simply need to remove the tensioner from the lid and manually insert the proximal opposing bottom side tabs of the tensioner into the slits/cuts on the front of the box and bend the tensioner towards the material roll per the same final step instructions used on any tensioner attachment configurations, as shown in FIG. 15.

Figure 15:
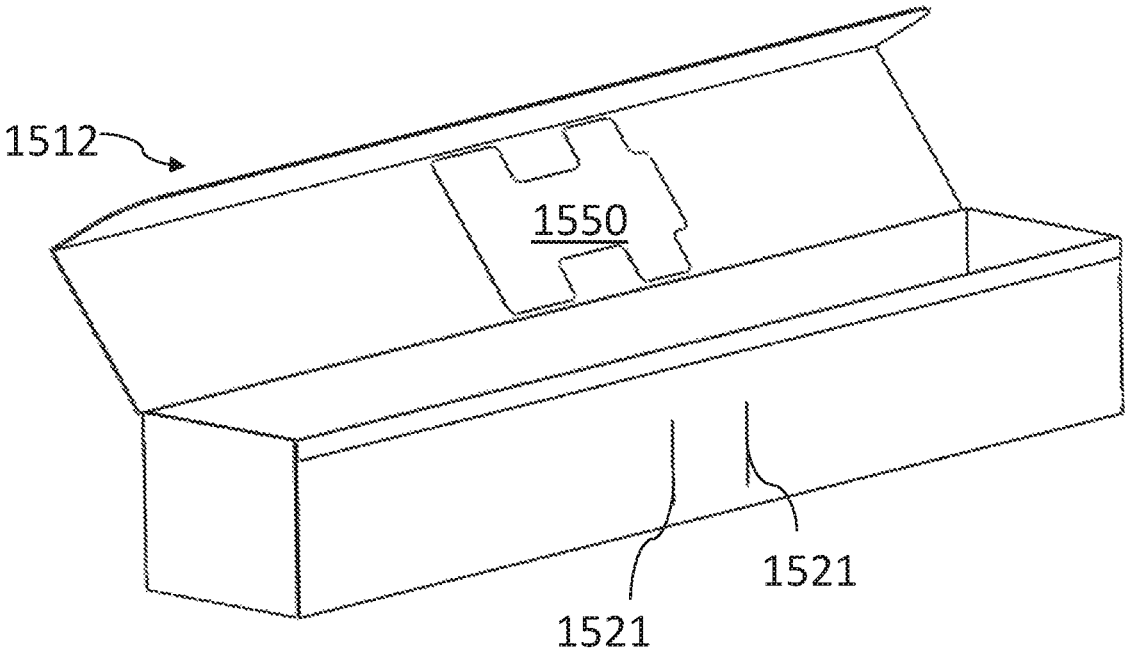
FIG. 15 illustrates an isometric view of another embodiment of a dispenser box with a roll tensioner housed therein.

In FIG. 15, the two parallel slits or kiss cuts, with or without nicks 1521 are provided for receiving tensioner 1550. Tensioner 1550 is shown attached to inside lid of box 1512 for later removal and install by an end user. This would provide yet another option to a manufacturer if they did not wish to include the tensioner slide assembly but did want to provide the tensioner as part of the packaging supplied with the wrapping material. This option would offer a lower risk to an unknown packaging change and could be brought to market much quicker.

Figure 16A:
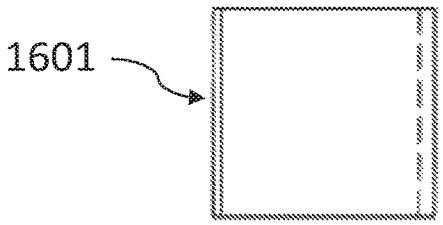
FIG. 16*a* shows a top plan view of a wrapping material tensioner dispenser with magnetic strip.
Figure 16B:
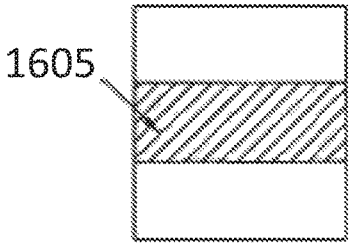
FIG. 16*b* shows a rear view of the dispenser of FIG. 16*a;*
Figure 16C:
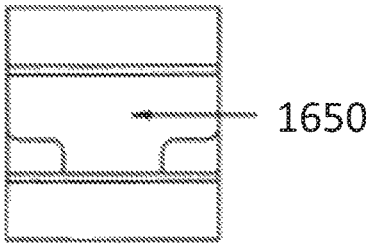
FIG. 16*c* shows a front view of the dispenser of FIG. 16*a;*
Figure 16D:
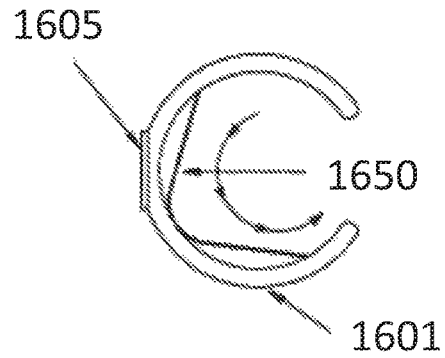
FIG. 16*d* shows an end view of the dispenser of FIG. 16*a;*
Figure 16E:
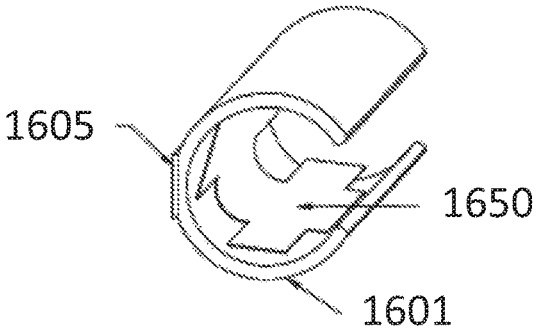
FIG. 16*e* shows an isometric view of an embodiment of a wrapping material tensioner in the dispenser of FIG. 16*a*.
Figure 16F:
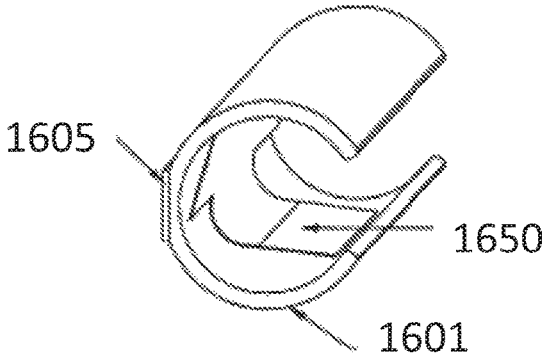
FIG. 16*f* shows an isometric view of another embodiment of a wrapping material tensioner in the dispenser of FIG. 16*a*.

FIGS. 16*a*-16*f* illustrate an embodiment of a wrapping material tensioner dispenser with a magnetic strip. FIG. 16*a* shows a top plan view of a wrapping material tensioner dispenser with a magnetic strip. FIG. 16*b* shows a rear view of the dispenser of FIG. 16*a*. FIG. 16*c* shows a front view of the dispenser of FIG. 16*a*. FIG. 16*d* shows an end view of the dispenser of FIG. 16*a*. FIG. 16*e* shows an isometric view of an embodiment of a wrapping material tensioner in the dispenser of FIG. 16*a*. FIG. 16*f* shows an isometric view of another embodiment of a wrapping material tensioner in the dispenser of FIG. 16*a*. This embodiment, encompasses a dispenser 1601 having a tubular shape/wall, which has been designed with two main features: 1—A portion of the cylindrical or tubular wall has been removed in order to create a radial opening to allow access and dispense the tensioners 1650 one by one as needed via opening. 2—On the rear portion of the same tubular wall, opposite the opening, a section of the tubular wall can be adapted to accept a magnetic strip 1605 so that the dispenser can be readily mounted to a steel surface such as a refrigerator, freezer or cabinet wall or door. The design of this dispenser, takes advantage of the wrapping material tensioner properties in that once bent, it will tend to go back to its original flat configuration, thus using this spring back reversion feature to allow the tensioners to hold in place, stacked inside the tubular dispenser, till due to the tensioner's low coefficient of friction one can easily reach in thru the radial opening of the dispenser with a finger and slide out one tensioner at a time.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the present disclosure and various embodiments with various modifications as are suited to the particular use contemplated.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A method of manufacture of a dispensing box with a roll tensioner for housing a material roll and maintaining a material cutting edge during use, said dispensing box comprising a front wall with a top edge having a cutter strip and a bottom edge abutting a bottom wall, back wall, top wall with closure flap and end walls adapted to form an interior for housing said material roll, said method comprising the steps of:

a. forming a tensioner slide assembly integrated in said front wall of said dispensing box in a flat configuration, said tensioner slide assembly comprising:
   (i) two opposing parallel slits extending on said front wall of said dispensing box;
   (ii) two opposing parallel slots adjoining said slits extending through said front wall of said dispensing box, said parallel slots sharing a primary assembly side wall with said parallel slits;
   (iii) two opposing parallel locking flaps integrated with said parallel slots sharing a secondary assembly wall side with said parallel slots, said locking flaps having flap top and flap bottom walls that are adapted to break-away terminating at a fold line, said locking flaps being in a stored position prior to use and adapted to open to a locking position when said flap top and flap bottom walls break-away upon application of force, bending said locking flaps outward along said fold line when said dispensing box is configured for use by an end-user;

b. affixing said cutter strip on said top edge of said front wall of said dispensing box;

c. inserting a roll tensioner into said parallel slits, said roll tensioner comprising distal and proximal end sections separated by a spring back/reversion section, said proximal end section having opposing bottom tabs and a center bottom tab and said distal end being adapted to bend downward via said spring back/reversion section when a force is applied, wherein said opposing bottom tabs of said roll tensioner are inserted through said parallel slots, wherein said roll tensioner is adapted to rest in a first position during non-use and to be slid down said parallel slots to said parallel slits into a second position when later engaged for use;

d. folding said dispensing box at bend or fold lines between said front wall and said bottom wall, and said back wall and said top wall with closure flap, and applying pressure to said closure flap and adhering said closure flap to said front wall by way of glue spots applied below said cutter strip;

e. inserting said material roll into said interior of said dispensing box, wherein said roll tensioner rests within said interior of said dispensing box proximal to said top edge of said front wall in said parallel slots with its distal end curving over said material roll laying proximal to said top wall of said dispensing box;

f. closing said end walls of said dispensing box and finishing packaging;

whereby said roll tensioner is adapted to rest in said first position until said roll tensioner is engaged to move into said second position during use, when in said second position said roll tensioner's distal end section is adapted to rest against said wrapping material proximal to said wrapping material cut edge to retain said wrapping material cut edge in an upward, substantially parallel position to said interior front wall of said wrapping material box for easy grasping of said wrapping material cut edge.

2. The method of manufacture as recited by claim 1, wherein said parallel slits comprise one or more kiss cuts, cut-scores, nicks or connection points adapted to breakaway.

3. The method of manufacture as recited by claim 1, wherein said parallel slits comprise a bottom end point, said bottom end point located a distance "s" perpendicular from said bottom edge of said front wall.

4. The method of manufacture as recited by claim 3, wherein said distance "s" is at least ¼" (6.35 mm) from said bottom edge of said front wall.

5. The method of manufacture as recited by claim 3, wherein said parallel slits extend from said bottom end point to a top end point adjoining said parallel slots, said parallel slots terminating at said cutter strip.

6. The method of manufacture as recited by claim 1, wherein said parallel slots have a greater width than said parallel slits.

7. The method of manufacture as recited by claim 1, wherein said locking flaps have a flap height and said parallel slots have a slot height, wherein said flap height is less than said slot height.

8. The method of manufacture as recited by claim 1, wherein said distal end of said roll tensioner has opposing top tabs forming a "T" distal end section.

9. The method of manufacture as recited by claim 1, wherein said opposing bottom tabs of said roll tensioner are mounted within said parallel slots so that said opposing bottom tabs of said roll tensioner are proximal to said cutter strip of said front wall of said dispensing box in said first position.

10. The method of manufacture as recited by claim 1, wherein said folding step comprises folding said front wall inward along a bend or fold line "A" located between said front wall and said bottom wall towards said interior of said dispensing box.

11. The method of manufacture as recited by claim 10, wherein said folding step comprises folding said top wall with said closure flap inward along a bend or fold line "B" and adhering said closure flap to said front wall.

12. The method of manufacture as recited by claim 1, wherein said first position of said roll tensioner comprises said opposing bottom tabs of said roll tensioner located at a slot top of said parallel slots proximal to said cutter strip of said front wall of said dispensing box when said roll tensioner is in non-use or disengaged for shipping, and wherein said second position of said roll tensioner comprises said opposing bottom tabs of said roll tensioner slid downward and located at said bottom end point of said parallel slits for use or engagement.

13. The method of manufacture as recited by claim 1, wherein said step of inserting said roll tensioner into said parallel slots comprises using a mandrel and adjustable saddle assembly, said mandrel comprising a cylindrical or half-round/less than half-round partial cylinder shape adapted to engage said opposing bottom tabs of said proximal end section of said roll tensioner circumferentially thereon attached to a substantially flat mandrel bed adapted to hold said distal end section of said roll tensioner substantially flat, and wherein said saddle is arched to circumferentially apply pressure over said opposing bottom tabs, said opposing bottom tabs of said roll tensioner being bent to be aligned with said parallel slots of said front wall of said dispensing box so that said opposing bottom tabs insert into said parallel slots.

14. A method of manufacture of a dispensing box with a roll tensioner for housing a material roll and maintaining a material cutting edge during use, said dispensing box comprising a front wall with a top edge having a cutter strip and a bottom edge abutting a bottom wall, back wall, top wall with closure flap and end walls adapted to form an interior for housing said material roll, said method comprising the steps of:

a. forming a tensioner slide assembly integrated in said front wall of said dispensing box, said tensioner slide assembly comprising:
   (i) two opposing parallel slits extending on said front wall of said dispensing box;
   (ii) two opposing parallel slots adjoining said slits extending on said front wall of said dispensing box, said parallel slots sharing a primary assembly side wall with said parallel slits;
   (iii) two opposing parallel locking flaps integrated with said parallel slots sharing a secondary assembly wall side with said parallel slots, said locking flaps having flap top and flap bottom walls that are adapted to break-away terminating at a fold line, said locking flaps being in a stored position prior to use and adapted to open to a locking position when said flap top and flap bottom walls break-away when force is applied bending said locking flaps outward along said fold line when said dispensing box is configured for use by an end-user;
b. inserting a roll tensioner into said parallel slots, said roll tensioner comprising distal and proximal end sections separated by a spring back/reversion section, said proximal end section having opposing bottom tabs and a center bottom tab and said distal end being adapted to bend downward via said spring back/reversion section when a force is applied, wherein said opposing bottom tabs of said roll tensioner are inserted through said parallel slots, wherein said roll tensioner is adapted to rest in said first position during non-use and to be slid down said parallel slots into said parallel slits into said second position when later engaged for use;

whereby said roll tensioner is adapted to rest in said first position until said roll tensioner is engaged to move into said second position during use, when in said second position said roll tensioner's distal end section is adapted to rest against said wrapping material proximal to said wrapping material cut edge to retain said wrapping material cut edge in an upward, substantially parallel position to said interior front wall of said wrapping material box for easy grasping of said wrapping material cut edge.

15. The method of manufacture as recited by claim 14, wherein said first position of said roll tensioner comprises said opposing bottom tabs of said roll tensioner located at a slot top of said parallel slots proximal to said cutter strip of said front wall of said dispensing box when said roll tensioner is in non-use or disengaged for shipping, and wherein said second position of said roll tensioner comprises said opposing bottom tabs of said roll tensioner slid downward and located at said bottom end point of said parallel slits for use or engagement.

16. A dispensing box with a roll tensioner system for housing a material roll and maintaining a material cutting edge during use, said dispensing box comprising a front wall with a top edge having a cutter strip and a bottom edge abutting a bottom wall, back wall, top wall with closure flap and end walls adapted to form an interior for housing said material roll, comprising a tensioner slide assembly adapted to receive said roll tensioner, said tensioner slide assembly integrated in said front wall of said dispensing box in a flat configuration, said tensioner slide assembly comprising:

(i) two opposing parallel slits located on said front wall of said dispensing box,
(ii) two opposing parallel slots adjoining said slits extending on said front wall of said dispensing box, said parallel slots sharing a primary assembly side wall with said parallel slits;
(iii) two opposing parallel locking flaps integrated with said parallel slots sharing a secondary assembly wall side with said parallel slots, said locking flaps having flap top and flap bottom walls that are adapted to break-away terminating at a fold line, said locking flaps being in a stored position prior to use and adapted to open to a locking position when said flap top and flap bottom walls break-away when force is applied bending said locking flaps outward along said fold line when said dispensing box is configured for use by an end-user.

17. The system as recited by claim 16 comprising at least one roll tensioner comprising distal and proximal end sections separated by a spring back/reversion section, said proximal end section having opposing bottom tabs and a center bottom tab and said distal end being adapted to bend downward via said spring back/reversion section when a force is applied, wherein said opposing bottom tabs of said roll tensioner are adapted to be inserted through said parallel slots, wherein said roll tensioner is adapted to rest in a first position during non-use and slid down said parallel slits into a second position when later engaged for use.

18. The system as recited by claim 17 comprising a roll tensioner dispenser for housing a plurality of roll tensioners.

19. The system as recited by claim 18, wherein said roll tensioner dispenser comprises a magnet.

20. A method of using a dispensing box with a roll tensioner system for housing a material roll and maintaining a material cutting edge during use, said dispensing box comprising a front wall with a top edge having a cutter strip and a bottom edge abutting a bottom wall, back wall, top wall with closure flap and end walls adapted to form an interior for housing said material roll, said method comprising the steps of:

a. opening a dispensing box to expose said material roll and said roll tensioner, said roll tensioner comprising distal and proximal end sections separated by a spring back/reversion section, said proximal end section having opposing bottom tabs and a center bottom tab and said distal end being adapted to bend downward via said spring back/reversion section when a force is applied, b. preparing said roll tensioner for use by sliding said roll tensioner resting in a first position in a tensioner slide assembly to a second position, said tension slide assembly integrated in said front wall of said dispensing box, comprising:

(i) two opposing parallel slits extending on said front wall of said dispensing box, (ii) two opposing parallel slots adjoining said slits extending on said front wall of said dispensing box, said parallel slots sharing a primary assembly side wall with said parallel slits;

(iii) two opposing parallel locking flaps integrated with said parallel slots sharing a secondary assembly wall side with said parallel slots, said locking flaps having flap top and flap bottom walls that are adapted to break-away terminating at a fold line, said locking flaps being in a stored position prior to use and adapted to open to a locking position when said flap top and flap bottom walls break-away when force is applied bending said locking flaps outward along said fold line when said dispensing box is configured for use by an end-user;

c. breaking away or separating said parallel slits and sliding said roll tensioner from said first position downward from said parallel slots to said second position in said parallel slits so that said opposing bottom tabs of said roll tensioner abuts a bottom end point of said parallel slits;

d. activating said locking flaps by opening said locking flaps and breaking away said flap top and flap bottom walls bending at said bend wall to said locking position;

whereby said roll tensioner is adapted to rest in said first position until said roll tensioner is engaged to move into said second position during use, when in said second position said roll tensioner's distal end section is adapted to rest against said wrapping material proximal to said wrapping material cut edge to retain said wrapping material cut edge in an upward, substantially parallel position to an interior front wall of said wrapping material box for easy grasping of said wrapping material cutting edge.

21. The method of using a dispensing box with a roll tensioner system as recited by claim 20 comprising the step of removing said wrapping material roll from said dispensing box after opening a dispensing box step.

22. The method of using a dispensing box with a roll tensioner system as recited by claim 21 comprising the step of replacing said wrapping material roll into said dispensing box after activating said locking flaps and bending tensioner distal end downward abutting material roll via said spring back/reversion section.

23. The method of using a dispensing box with a roll tensioner system as recited by claim 20 comprising the step of bending the front wall outward to create a space to bend the distal end of tensioner so that it can rest against the material roll after activating said locking flaps.

* * * * *